US007929887B2

(12) United States Patent
Mestha et al.

(10) Patent No.: US 7,929,887 B2
(45) Date of Patent: Apr. 19, 2011

(54) DIRECT IMAGING SYSTEM WITH ADDRESSABLE ACTUATORS ON A DEVELOPMENT BELT

(75) Inventors: Lalit K. Mestha, Fairport, NY (US); Pinyen Lin, Rochester, NY (US); Baomin Xu, San Jose, CA (US); John G. Shaw, Victor, NY (US); Palghat Ramesh, Pittsford, NY (US); Peter Michael Gulvin, Webster, NY (US)

(73) Assignees: Xerox Corporation, Norwalk, CT (US); Palo Alto Research Center Incorporated, Palo Alto, CA (US)

( * ) Notice: Subject to any disclaimer, the term of this patent is extended or adjusted under 35 U.S.C. 154(b) by 295 days.

(21) Appl. No.: 12/362,907

(22) Filed: Jan. 30, 2009

(65) Prior Publication Data

US 2009/0190969 A1 Jul. 30, 2009

Related U.S. Application Data

(63) Continuation-in-part of application No. 12/208,116, filed on Sep. 10, 2008, which is a continuation-in-part of application No. 12/019,051, filed on Jan. 24, 2008.

(51) Int. Cl.
*G03G 15/08* (2006.01)

(52) U.S. Cl. ..... 399/266; 399/278; 399/252

(58) Field of Classification Search ..... 399/252, 399/265, 266, 272, 276–278
See application file for complete search history.

(56) References Cited

U.S. PATENT DOCUMENTS

| | | | | |
|---|---|---|---|---|
| 5,523,827 | A | 6/1996 | Snelling et al. | |
| 5,809,385 | A * | 9/1998 | Snelling et al. | 399/266 |
| 6,385,429 | B1 | 5/2002 | Weber et al. | |
| 6,697,592 | B2 * | 2/2004 | Adachi et al. | 399/265 |

* cited by examiner

*Primary Examiner* — David P Porta
*Assistant Examiner* — Jessica L Eley
(74) *Attorney, Agent, or Firm* — MH2 Technology Law Group LLP

(57) ABSTRACT

Exemplary embodiments provide a direct imaging system and methods for direct marking an image using the system. The disclosed direct imaging system can eliminate the creation of a latent image and can be used in an electrophotographic machine and related processes. Specifically, the direct imaging system can include a direct marking substrate (e.g., a printing substrate) and a development belt member closely spaced from the direct marking substrate. In one embodiment, the development belt member can include a plurality of actuator cells with each actuator cell controllably addressable to eject one or more toner particles adhered thereto. The ejected toner particles can transit the space between the donor belt member and the direct marking substrate, and directly marking onto the direct marking substrate forming an image.

20 Claims, 12 Drawing Sheets

DIRECT IMAGING SYSTEM WITH ADDRESSABLE ACTUATORS ON A DEVELOPMENT BELT

RELATED APPLICATIONS

This application is a continuation-in-part of U.S. patent application Ser. No. 12/208,116, entitled "Direct Imaging System with Addressable Actuators on a Development Roll," filed Sep. 10, 2008, which is hereby incorporated by reference in its entirety and which is a continuation-in-part of U.S. patent application Ser. No. 12/019,051, entitled "Smart Donor Rolls using Individually Addressable Piezoelectric Actuators," filed Jan. 24, 2008, which is hereby incorporated by reference in its entirety.

FIELD OF THE INVENTION

This invention relates generally to electrophotographic printing techniques and, more particularly, to a direct imaging system without use of a latent image for electrophotographic printing machines and related processes.

BACKGROUND OF THE INVENTION

Electrostatic reproduction involves an electrostatically-formed latent image on a photoconductive member, or photoreceptor. The latent image is developed by bringing charged developer materials into contact with the photoconductive member. The developer materials can include two-component developer materials including carrier particles and charged toner particles for such as "hybrid scavengeless development" having an image-on-image development. The developer materials can also include single-component developer materials including only toner particles. The toner particles adhere directly to a donor roll by electrostatic charges from a magnet or developer roll and are transferred to the photoconductive member from a toner cloud generated in the gap between the photoreceptor and the donor roll during the development process. The latent image on the photoreceptor can further be transferred onto a printing substrate.

During the printing process, one challenge is how to reliably and efficiently move charged toner particles from one surface to another surface, e.g., from carrier beads to donors, from donors to photoreceptors, and/or from photoreceptors to papers, due to toner adhesion on surfaces. For example, distributions in toner adhesion properties and spatial variations in surface properties (e.g. filming on photoreceptor) of the adhered toner particles lead to image artifacts, which are difficult to compensate for. Conventional solutions for compensating for these image artifacts include a technique of image based controls. However, such technique mainly compensates for the artifacts of periodic banding. To compensate for other artifacts such as mottle and streaks, conventional solutions also include a mechanism of modifying the toner material state using maintenance procedures (e.g., toner purge), but at the expense of both productivity and run cost.

In addition, for today's non-contact development subsystems, the image fields are insufficient to detach toner particles from the donor roll and move them to the photoreceptor. For example, conventional donor rolls use wire electrodes to generate toner clouds. Generally, AC biased wires have been used to provide electrostatic forces to release the toner particles from the donor roll. However, there are several problems with wires. First, toner particles tend to adhere to the wires after prolonged usage even with a non-stick coating on the wires. The adhered toner particles may cause image defects, such as streaks and low area coverage developability failures. Second, it is not easy to keep the wires clean once the wires are contaminated with toner components. The wires thus need frequent maintenance or replacement. Third, depending on the printing media and image, adhesion forces vary along the surface of the development and transfer subsystems Use of wires makes it difficult to extend the development for wide-area printing.

Thus, there is a need to overcome these and other problems of the prior art and to provide a roll member having image-wise addressability used as a replacement to wires to control toner quality and to provide a direct imaging system without using a photoreceptor.

SUMMARY OF THE INVENTION

According to various embodiments, the present teachings include a direct imaging system. The direct imaging system can include a direct marking substrate and a belt member closely spaced from the direct marking substrate. The belt member can include a plurality of actuator cells with each actuator cell addressable to eject one or more toner particles adhered thereto. The ejected toner particles can then transit the space between the belt member and the direct marking substrate and onto the direct marking substrate forming an image. Such direct imaging system does not need to include the charge subsystem and/or an exposure subsystem.

According to various embodiments, the present teachings also include a method for direct marking an image. In this method, a direct marking substrate can be provided for a belt member to be closely spaced therefrom. The belt member can include a plurality of actuator cells with each actuator cell addressable to eject one or more toner particles attracted thereto. At least one actuator cell of the plurality of actuator cells can then be vibrated to transit the ejected toner particles onto the direct marking substrate forming an image without using a latent image.

According to various embodiments, the present teachings further include a direct imaging system. The direct imaging system can include a direct marking substrate that is free of at least one of a charge subsystem and an exposure subsystem. The direct imaging system can also include a donor belt member closely spaced from the direct marking substrate for advancing toner particles onto the direct marking substrate. The donor roll can include a plurality of actuator cells with each actuator cell controllably addressable by one of an addressing logic circuit and/or a wireless communication to eject one or more toner particles attracted thereto. The ejected toner particles can then transit the space between the donor belt and the direct marking substrate and onto the direct marking substrate to form an image. The direct imaging system can further include a stripping roll disposed with respect to the donor belt to reduce background noise of the image on the direct marking substrate.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments of the invention and together with the description, serve to explain the principles of the invention.

DESCRIPTION OF THE EMBODIMENTS

Figure 1A:
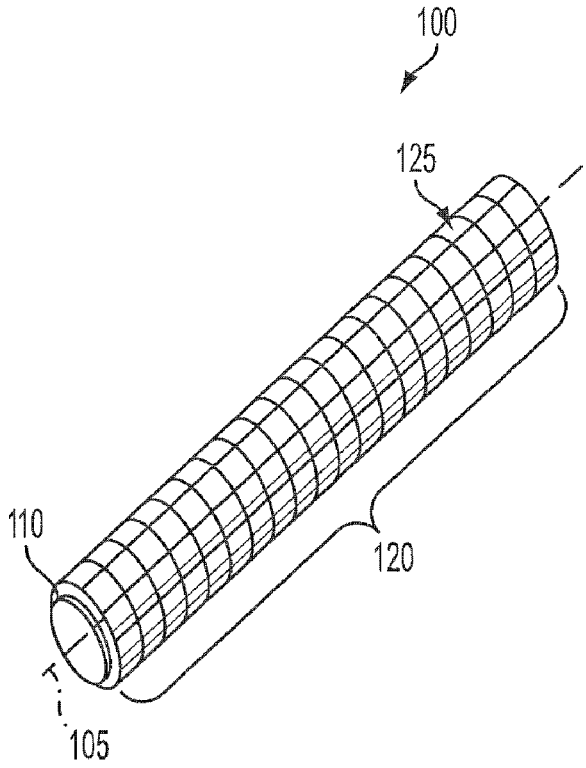
FIGS. 1A-1B depict an exemplary roll member including a piezoelectric tape mounted upon a roll substrate in accordance with the present teachings.

Reference will now be made in detail to the present embodiments (exemplary embodiments) of the invention, examples of which are illustrated in the accompanying drawings. Wherever possible, the same reference numbers will be used throughout the drawings to refer to the same or like parts. In the following description, reference is made to the accompanying drawings that form a part thereof, and in which is shown by way of illustration specific exemplary embodiments in which the invention may be practiced. These embodiments are described in sufficient detail to enable those skilled in the art to practice the invention and it is to be understood that other embodiments may be utilized and that changes may be made without departing from the scope of the invention. The following description is, therefore, merely exemplary.

While the invention has been illustrated with respect to one or more implementations, alterations and/or modifications can be made to the illustrated examples without departing from the spirit and scope of the appended claims. In addition, while a particular feature of the invention may have been disclosed with respect to only one of several implementations, such feature may be combined with one or more other features of the other implementations as may be desired and advantageous for any given or particular function. Furthermore, to the extent that the terms "including", "includes", "having", "has", "with", or variants thereof are used in either the detailed description and the claims, such terms are intended to be inclusive in a manner similar to the term "comprising." As used herein, the term "one or more of" with respect to a listing of items such as, for example, A and B, means A alone, B alone, or A and B. The term "at least one of" is used to mean one or more of the listed items can be selected.

Notwithstanding that the numerical ranges and parameters setting forth the broad scope of the invention are approximations, the numerical values set forth in the specific examples are reported as precisely as possible Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume values as defined earlier plus negative values, e.g. −1, −1.2, −1.89, −2, −2.5, −3, −10, −20, −30, etc.

Exemplary embodiments provide a roll member that includes one or more piezoelectric tapes and methods for making and using the roll member. The piezoelectric tape can be flexible and include a plurality of piezoelectric elements configured in a manner that the piezoelectric elements can be addressed individually and/or be divided into and addressed as groups with various numbers of elements in each group. For this reason, the plurality of piezoelectric elements can also be referred to herein as the plurality of controllable piezoelectric elements. In an exemplary embodiment, the disclosed roll member can be used as a donor roll for a development system of an electrophotographic printing machine to create toner powder cloud for high quality image development, such as image on image in hybrid scavengeless development (HSD) system. For example, when a feed forward image content information is available, the toner cloud can be created only where development is needed.

As used herein, the term "roll member" or "smart roll" refers to any member that requires a surface actuation and/or vibration in a process, e.g., to reduce the surface adhesion of toner particles, and thus actuate the toner particles to transfer to a subsequent member. Note that although the term "roll member" is referred to throughout the description herein for illustrative purposes, it is intended that the term also encompass other members that need an actuation/vibration function on its surface including, but not limited to, a belt member, a film member, and the like. Specifically, the "roll member" can include one or more piezoelectric tapes mounted over a substrate. The substrate can be a conductive or non-conductive substrate depending on the specific design and/or engine architecture.

The "piezoelectric tape" can be a strip (e.g., long and narrow) that is flexible at least in one direction and can be easily mounted on a curved substrate surface, such as a cylinder roll. As used herein, the term "flexible" refers to the ability of a material, structure, device or device component to be deformed into a curved shape without undergoing a transformation that introduces significant strain, such as strain characterizing the failure point of a material, structure, device, or device component. The "piezoelectric tape" can include, e.g., a plurality of piezoelectric elements disposed (e.g. sandwiched) between two tape substrates. The tape substrate can be conductive and flexible at least in one direction. The tape substrate can include, for example, a conductive material, or an insulative material with a surface conductive layer. For example, the two tape substrates can include, two metallized polymer tapes, one metallized polymer tape and one metal foil, or other pairs. The metallized polymer tape can further include surface metallization layer formed on an insulative polymer material including, for example, polyester such as polyethylene terephthalate (PET) with a trade name of Mylar and Melinex, and polyimide such as with a trade name of Kapton developed by DuPont. The metallization layer can be patterned, in a manner such that the sandwiched piezoelectric elements can be addressed individually or as groups with various numbers of elements in each group. In addition, the piezoelectric tape can provide a low cost fabrication as it can be batch manufactured.

Figure 1B:
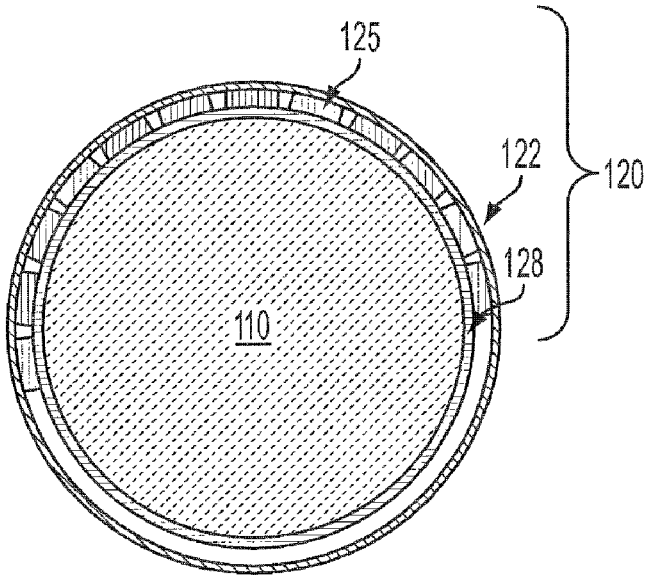

FIGS. 1A-1B depict an exemplary roll member 100 including a piezoelectric tape mounted upon a roll substrate in accordance with the present teachings. In particular, FIG. 1A is a perspective view in partial section of the exemplary roll member 100, while FIG. 1B is a cross-sectional view of the exemplary roll member 100 shown in FIG. 1A. It should be readily apparent to one of ordinary skill in the art that the roll member depicted in FIGS. 1A-1B represents a generalized schematic illustration and that other elements/tapes can be added or existing elements/tapes can be removed or modified.

As shown in FIG. 1A, the exemplary roll member 100 can include a roll substrate 110, and a piezoelectric tape 120. The piezoelectric tape 120 can be mounted upon the roll substrate 110.

The substrate 110 can be formed in various shapes, e.g., a cylinder, a core, a belt, or a film, and using any suitable material that is non-conductive or conductive depending on a specific configuration. For example, the substrate 110 can take the form of a cylindrical tube or a solid cylindrical shaft of, for example, plastic materials or metal materials (e.g., aluminum, or stainless steel) to maintain rigidity, structural integrity. In an exemplary embodiment, the substrate 110 can be a solid cylindrical shaft. In various embodiments, the substrate 110 can have a diameter of the cylindrical tube of about 30 mm to about 300 mm, and have a length of about 100 mm to 1000 mm.

The piezoelectric tape 120 can be formed over, e.g., wrapped around, the substrate 110 as shown in FIG. 1. The piezoelectric tape 120 can include a layered structure (see FIG. 1B) including a plurality of piezoelectric elements 125 disposed between a first tape substrate 122 and a second tape substrate 128. In various embodiments, the piezoelectric tape 120 can be wrapped around the roll substrate 110 in a manner that the plurality of piezoelectric elements 125 can cover wholly or partially (see FIG. 1B) on the peripheral circumferential surface of the substrate 110.

Figure 2:
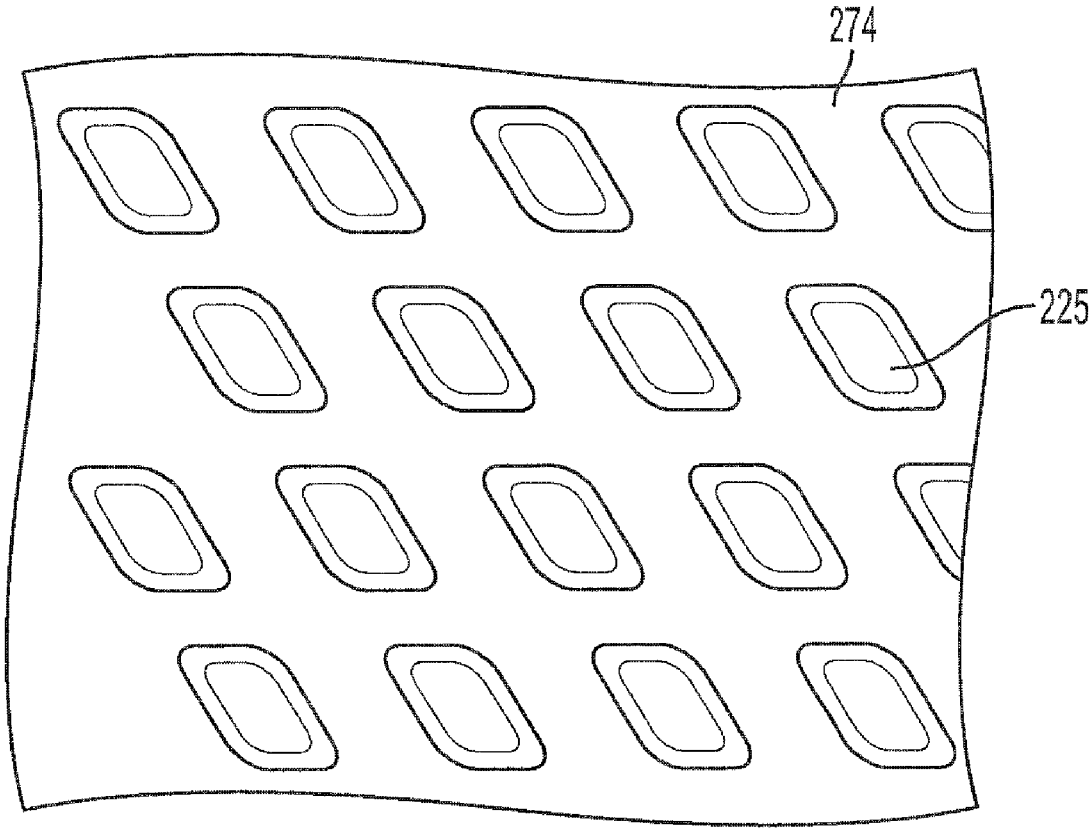
FIG. 2 depicts a top view of exemplary piezoelectric elements in a non-curved condition in accordance with the present teachings.

The plurality of piezoelectric elements 125 can be arranged, e.g., as arrays. For example, FIG. 2 depicts a top view of the exemplary piezoelectric element arrays 225 formed on a substrate 274 (e.g., sapphire) in accordance with the present teachings. As shown, the piezoelectric element arrays 225 can be formed in a large area containing a desired element number. It should be noted that although the piezoelectric elements shown in FIG. 2 are in parallelogram shape, any other suitable shapes, such as, for example, circular, rectangular, square, or long strip shapes, can also be used for the piezoelectric elements.

In various embodiments, the array 225 of the piezoelectric elements can have certain geometries or distributions according to specific applications. In addition, each piezoelectric element as disclosed (e.g., 125/225 in FIGS. 1-2) can be formed in a variety of different geometric shapes for use in a single piezoelectric tape 120. Further, the piezoelectric elements 125/225 can have various thicknesses ranging from about 10 μm to millimeter (e.g., 1 mm) in scale. For example, the piezoelectric element 125/225 can have a uniform thickness of about 100 μm in a single piezoelectric tape 120. In various embodiments, some of the plurality of piezoelectric elements 125 can have one thickness (e.g., about 100 μm), and others can have another one or more different thicknesses (e.g., about 50 μm). Furthermore, the piezoelectric elements 125/225 can include different piezoelectric materials, including ceramic piezoelectric elements such as soft PZT (lead zirconate titanate) and hard PZT, or other functional ceramic materials, such as antiferroelectric materials, electrostrictive materials, and magnetostrictive materials, used in the same single piezoelectric tape 120. The composition of the piezoelectric ceramic elements can also vary, including doped or undoped, e.g., lead zirconate titanate (PZT), lead titanate, lead zirconate, lead magnesium titanate and its solid solutions with lead titanate, lithium niobate, and lithium tantanate.

Referring back to FIGS. 1A-1B, each piezoelectric element 125 (or 225 in FIG. 2) mounted on the substrate 110 can be addressed individually and/or in groups with drive electronics mounted, e.g., on the side of a roll substrate 110, underneath the roll substrate 110, or distributed inside the piezoelectric tape 120. When the piezoelectric elements 125 are addressed in groups, the selection of each group, e.g., the selection of the number, shape, distribution of the piezoelectric elements 125 in each group, can be determined by the desired spatial actuation of a particular application. In various embodiments, an insulative material can be optionally inserted between the tape substrates 122 and 128 and around the plurality of piezoelectric elements 125 for electrical isolation. In an exemplary embodiment, due to the controllable addressing of each piezoelectric element 125, the roll member 100 can be used as a donor roll to release toner particles and generate a localized toner cloud for high quality image development such as for image on image printers.

Figure 3:
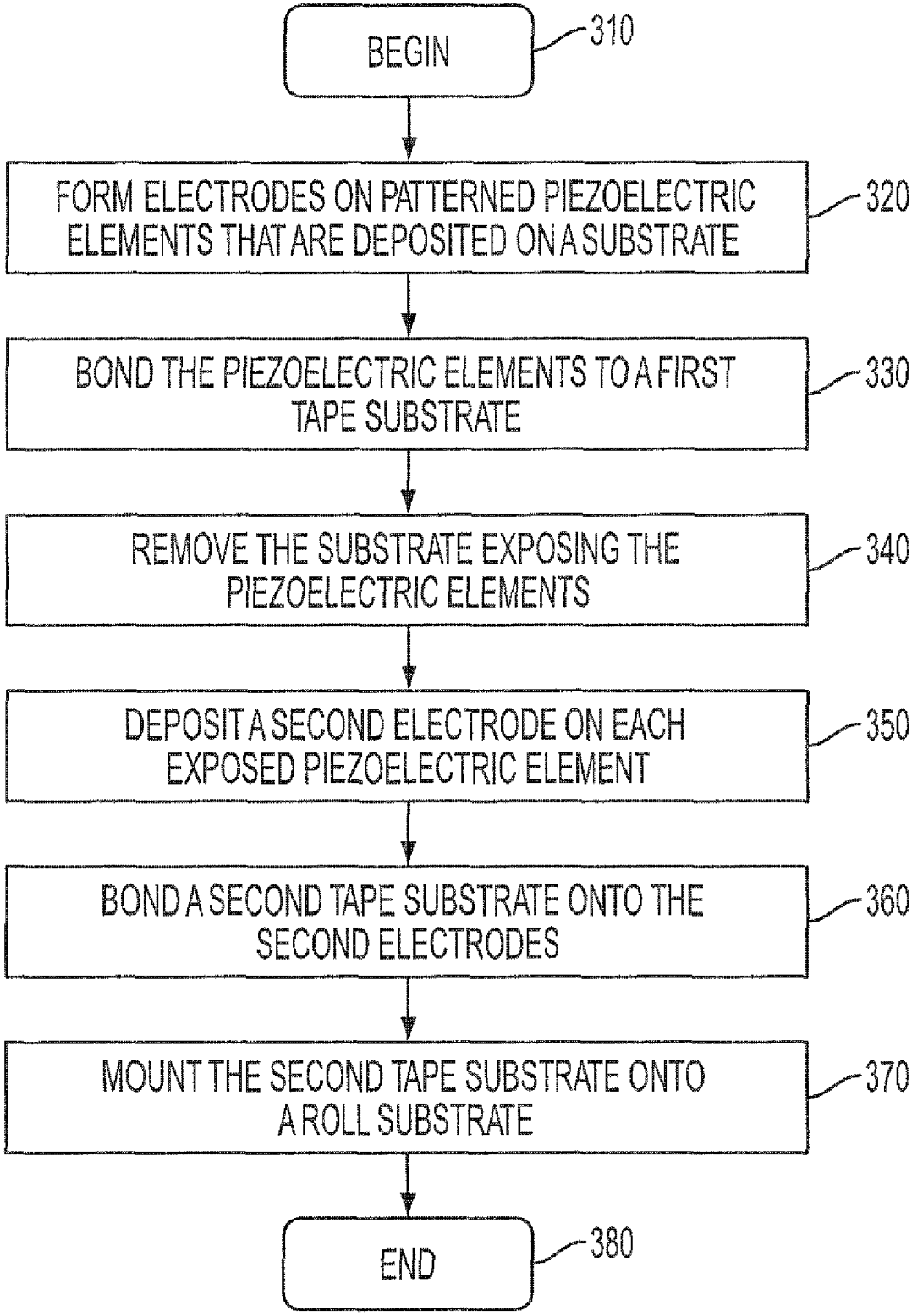
FIG. 3 illustrates an exemplary process flow for manufacturing the roll member of FIGS. 1-2 in accordance with the present teachings.

FIG. 3 illustrates an exemplary process flow 300 for manufacturing the roll member 100 of FIGS. 1-2 in accordance with the present teachings. While the exemplary process 300 is illustrated and described below as a series of acts or events, it will be appreciated that the present invention is not limited by the illustrated ordering of such acts or events. For example, some acts may occur in different orders and/or concurrently with other acts or events apart from those illustrated and/or described herein, in accordance with the present teachings. In addition, not all illustrated steps may be required to implement a methodology in accordance with the present teachings. Also, the following manufacturing techniques are intended to be applicable to the generation of individual elements and arrays of elements.

The process 300 begins at 310. At 320, patterned piezoelectric elements can be formed on a substrate, followed by forming an electrode over each patterned piezoelectric element.

For example, the piezoelectric elements can be ceramic piezoelectric elements that is first fabricated by depositing the piezoelectric material (e.g., ceramic type powders or inks) onto an appropriate substrate by use of, for example, a direct marking technology as known to one of ordinary skill in the art. The fabrication process can include sintering the material at a certain temperature, e.g., about 1100° C. to about 1350° C. Other temperature ranges can also be used in appropriate circumstance such as for densifications. Following the fabrication process, the surface of the formed structures of piezoelectric elements can be polished using, for example, a dry tape polishing technique. Once the piezoelectric elements have been polished and cleaned, electrodes can be deposited on the surface of the piezoelectric elements.

At 330, the piezoelectric elements can be bonded to a first tape substrate through the electrodes that are overlaid the piezoelectric elements. The first tape substrate can be flexible and conductive or has a surface conductive layer. For example, the first tape substrate can include a metal foil or a metallized polymer tape. In various embodiments, the tape substrate can be placed on a rigid carrier plate for an easy carrying during the fabrication process.

At 340, the substrate on which the piezoelectric elements are deposited can be removed through, for example, a liftoff process, using an exemplary radiation energy such as from a laser or other appropriate energy source. The releasing process can involve exposure of the piezoelectric elements to a radiation source through the substrate to break an attachment interface between the substrate and the piezoelectric elements. Additional heating can also be implemented, if necessary, to complete removal of the substrate.

At 350, once the liftoff process has been completed, a second electrode can be deposited on each exposed piezoelectric element. In various embodiments, the electric property, for example, a dielectric property, of each piezoelectric element can be measured to identify if the elements meet required criteria by, e.g., poling of the elements under high voltage.

At 360, a second tape substrate can be bonded to the second electrodes formed on the piezoelectric elements. In various embodiments, prior to bonding the second tape substrate, an insulative filler can be optionally inserted around the piezoelectric elements for electrical isolation. Again the second tape substrate can include, for example, a metal foil or metallized polymer tape.

At 370, the assembled arrangement including the piezoelectric elements sandwiched between the first and the second tape substrates can then be removed from the carrier plate. Such assembled arrangement can be used as a piezoelectric tape and further be mounted onto a roll substrate to form various roll members as indicated in FIGS. 1A-1B. The process 300 can conclude at 380.

Figure 4A:
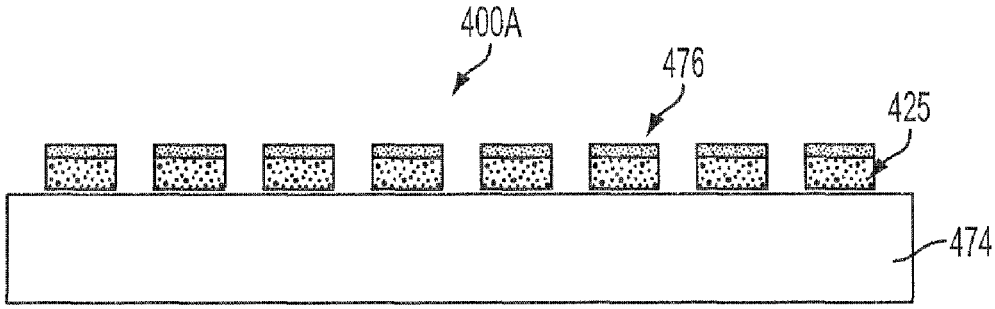
FIGS. 4A-4H depict an exemplary roll member at various stages during the fabrication according to the process flow of FIG. 3 in accordance with the present teachings.

FIGS. 4A-4H depict an exemplary roll member 400 at various stages of the fabrication generally according to the process flow 300 of FIG. 3 in accordance with the present teachings. In FIG. 4A, the device 400A can include a plurality of piezoelectric elements 425, a substrate 474, and a plurality of electrodes 476. The plurality of piezoelectric elements 425 can be formed on the substrate 474 and each piezoelectric element 425 can further have an electrode 476 formed thereon.

The piezoelectric elements 425, e.g., piezoelectric ceramic elements, can be deposited on the substrate 474, and then, for example, sintered at about 1100° C. to about 1350° C. for densification The depositing step can be achieved by a number of direct marking processes including screen printing, jet printing, ballistic aerosol marking (BAM), acoustic ejection, or any other suitable processes. These techniques can allow flexibility as to the type of piezoelectric element configurations and thicknesses. For example, when the piezoelectric elements 425 are made by screen printing, the screen printing mask (mesh) can be designed to have various shapes or openings resulting in a variety of shapes for the piezoelectric elements 425, such as rectangular, square, circular, ring, among others. Using single or multiple printing processes, the thickness of the piezoelectric elements 425 can be from about 10 μm to millimeter scale. In addition, use of these direct marking techniques can allow generation of very fine patterns and high density elements.

The substrate 474 used in the processes of this application can have certain characteristics, e.g., due to the high temperatures involved. In addition, the substrate 474 can be at least partially transparent for a subsequent exemplary liftoff process, which can be performed using an optical energy. Specifically, the substrate can be transparent at the wavelengths of a radiation beam emitted from the radiation source, and can be inert at the sintering temperatures so as not to contaminate the piezoelectric materials. In an exemplary embodiment, the substrate 474 can be sapphire. Other potential substrate materials can include, but not limited to, transparent alumina ceramics, aluminum nitride, magnesium oxide, strontium titanate, among others. In various embodiments, the selected substrate material can be reusable, which provides an economic benefit to the process.

In various embodiments, after fabrication of the piezoelectric elements 425 and prior to the subsequent formation of the electrodes 476, a polishing process followed by a cleaning process of the top surface of the piezoelectric elements 425 can be conducted to ensure the quality of the piezoelectric elements 425 and homogenizes the thickness of piezoelectric elements 425 of, such as a chosen group. In an exemplary embodiment, a tape polishing process, such as a dry tape polishing process, can be employed to remove any possible surface damages, such as due to lead deficiency, to avoid, e.g., a crowning effect on the individual elements. Alternatively, a wet polishing process can be used.

After polishing and/or cleaning of the piezoelectric elements 425, the metal electrodes 476, such as Cr/Ni or other appropriate materials, can be deposited on the surface of the piezoelectric elements 425 by techniques such as sputtering or evaporation with a shadow mask. The electrodes 476 can also be deposited by one of the direct marking methods, such as screen printing.

Figure 4B:
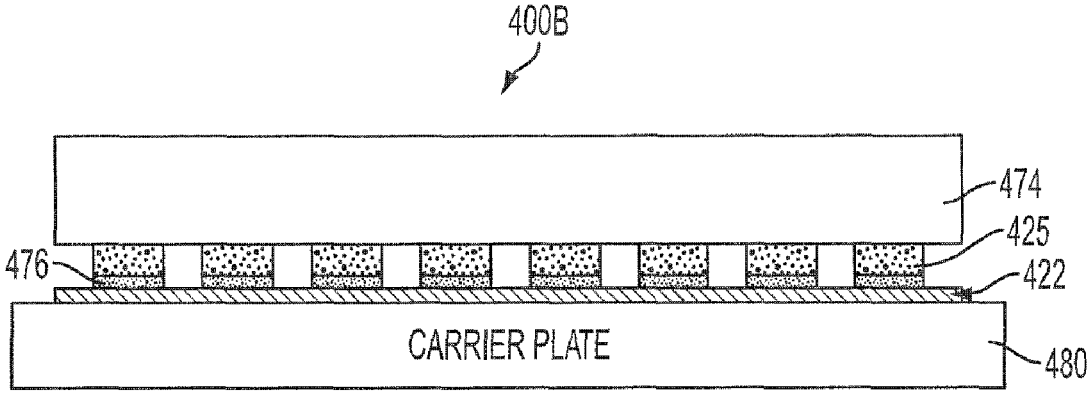

In FIG. 4B, the piezoelectric elements 425 along with the electrodes 476 can be bonded to a first tape substrate 422. The first tape substrate 422 can have a flexible and conductive material, such as a metal foil (thus it can also be used as common electrode) or a metallized tape, which can work as a common connection to all the piezoelectric elements 425. The metallized tape can include, for example, a metallization layer on a polymer. In various embodiments, the first tape substrate 422 can be carried on a carrier plate 480 using, e.g., a removable adhesive.

When bonding the exemplary metal foil 422 to the piezoelectric elements 425 through the electrodes 476, a conductive adhesive, e.g., a conductive epoxy, can be used. In another example, the bonding of the exemplary metal foil 422 with the electrodes 476 can be accomplished using a thin (e.g., less than 1 μm) and nonconductive epoxy layer (not shown), that contains sub-micron conductive particles (such as Au balls) to provide the electric contact between the surface electrode 476 of the piezoelectric elements 425 and the metal foil 422. That is, the epoxy can be conductive in the Z direction (the direction perpendicular to the surface of metal foil 422), but not conductive in the lateral directions.

In a further example, bonding to the first tape substrate 422 can be accomplished by using a thin film intermetallic transient liquid phase metal bonding after the metal electrode deposition, such as Cr/Ni deposition, to form a bond. In this case, certain low/high melting-point metal thin film layers can be used as the electrodes for the piezoelectric elements 425, thus in some cases it is not necessary to deposit the extra electrode layer 476, such as Cr/Ni. For example, the thin film intermetallic transient liquid phase bonding process can include a thin film layer of high melting-point metal (such as silver (Ag), gold (Au), Copper (Cu), or Palladium (Pd)) and a thin film layer of low melting-point metal (such as Indium (In), or Tin (Sn)) deposited on the piezoelectric elements 425 (or the first tape substrate 422) and a thin layer of high melting-point metal (such as Ag, Au, Cu, Pd) can be deposited on the first tape substrate 422 (or the piezoelectric elements 425) to form a bond. Alternatively, a multilayer structure with alternating low melting-point metal/high melting-point metal thin film layers (not shown) can be used.

Figure 4C:
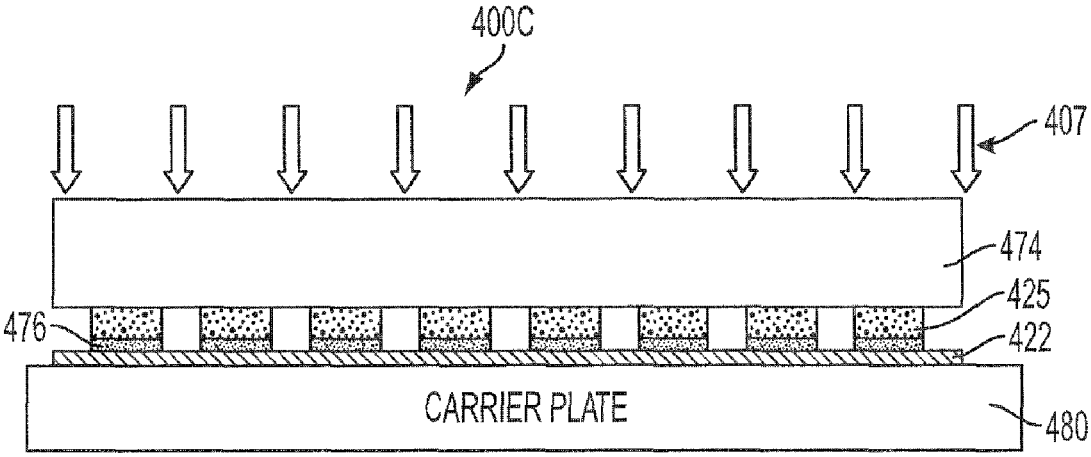

In FIG. 4C, the piezoelectric elements 425 can be released from substrate 474, e.g., using radiation of a beam through the substrate 474 during a liftoff process. The substrate 474 can first exposed to a radiation beam (e.g., a laser beam) from a radiation source (e.g., an excimer laser) 407, having a wavelength at which the substrate 474 can be at least partially transparent. In this manner a high percentage of the radiation beams can pass through the substrate 474 to the interface between the substrate 474 and elements 425. The energy at the interface can be used to break down the physical attachment between these components, i.e., the substrate 474 and the elements 425. In various embodiments, heat can be applied following the operation of the radiation exposure. For example, a temperature of about 40° C. to about 50° C. can be sufficient to provide easy detachment of any remaining contacts to fully release the piezoelectric elements 425 from the substrate 474.

Figure 4D:
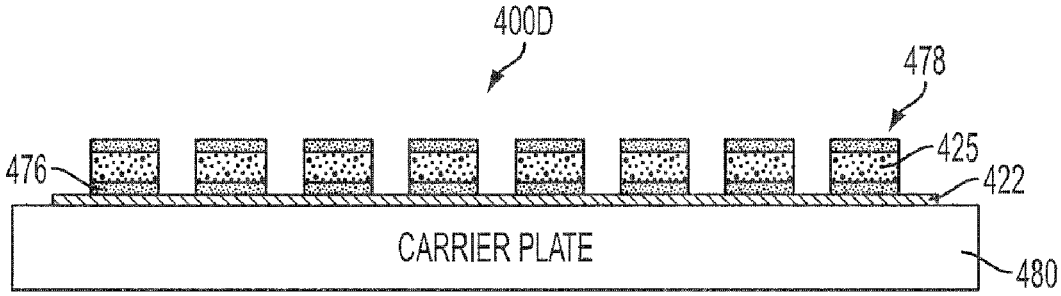

In FIG. 4D, a plurality of second electrodes 478, such as Cr/Ni, can be deposited on the released surfaces of the piezoelectric elements 425 with a shadow mask or by other appropriate methods. In various embodiments, after second electrode deposition, the piezoelectric elements 425 can be poled to measure piezoelectric properties as known in the art.

Figure 4E:
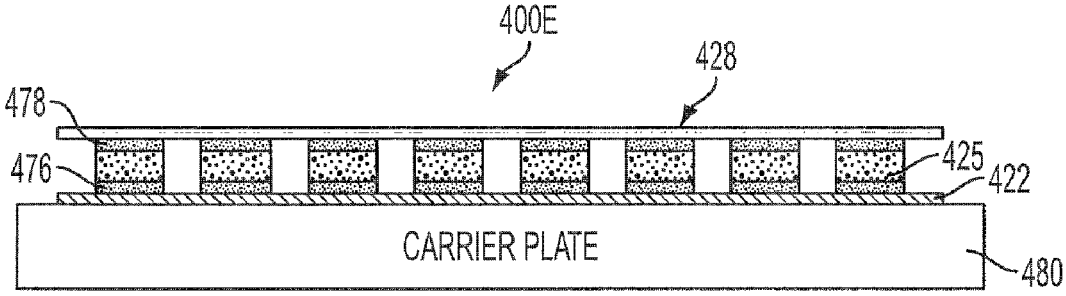
Figure 4F:
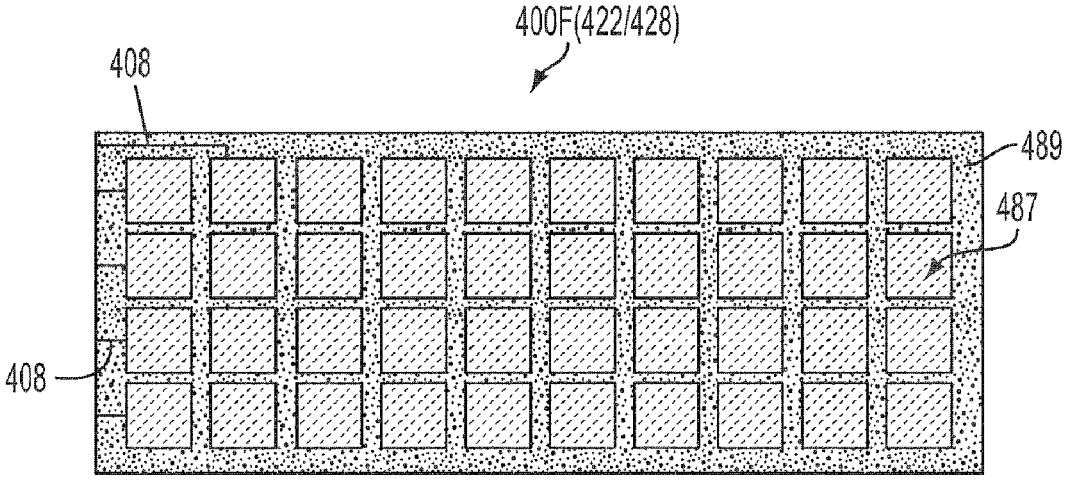

In FIG. 4E, the device 400 can include a second tape substrate 428, such as a metallized polymer tape as disclosed herein, bonded to the plurality of electrodes 478. FIG. 4F depicts an exemplary metallized polymer tape used for the first and the second tape substrates 422 (or 122 of FIG. 1B) and 428 (or 128 of FIG. 1B) of the device 400 (or the roll member 100 in FIGS. 1A-1B) in accordance with the present teachings. As shown, the metallized polymer tape can include a plurality of patterned surface metallizations 487 formed on an insulative material 489 such as a polymer. The plurality of patterned surface metallizations 487 can have various configurations for certain applications. For example, the surface metallizations 487 can be patterned on the exemplary polymer 489 in such a manner that the bonded piezoelectric elements 425 can be addressed individually or as groups with different numbers of elements in each group. In various embodiments, the metallization layer 487 on the polymer tape 489 can have no pattern for all the bonded piezoelectric elements 425 connected together. In various embodiments, the device 400 F, e.g., the first or the second tape substrate 422 or 428 of the device 400, can have an embedded conductive line 408 connecting each surface metallization 487 to a power supply (not shown) and exposed on the surface of the polymer tape 489, and to further contact each PZT element 487. For example, as shown in FIG. 4F, each exemplary connecting line 408 can be configured from the edge to each surface metallization 487 and thus to connect each PZT 425, e.g., when using the device configuration shown in FIG. 4E.

When bonding the second tape substrate 428 (see FIG. 4F) to the piezoelectric elements 425, each surface metallization 487 of the second tape substrate 428 can be bonded onto one of the electrodes 478 using, for example, thin nonconductive epoxy bonding containing submicron conductive ball, thin film intermetallic transient liquid phase bonding, or conductive adhesive. If appropriate, the second tape substrate 428 bonded to the piezoelectric elements 425 can also be placed on a rigid carrier plate, e.g., as similar to the carrier plate 480 for supporting and easy carrying the tape substrate 428 during the fabrication process. Optionally, filler materials, such as punched mylar or teflon or other insulative material, can be positioned between the piezoelectric elements 425 to electrically isolate the first tape substrate 422 and the second tape substrate 428 or the surface conductive layers of these substrates from each other.

Figure 4G:
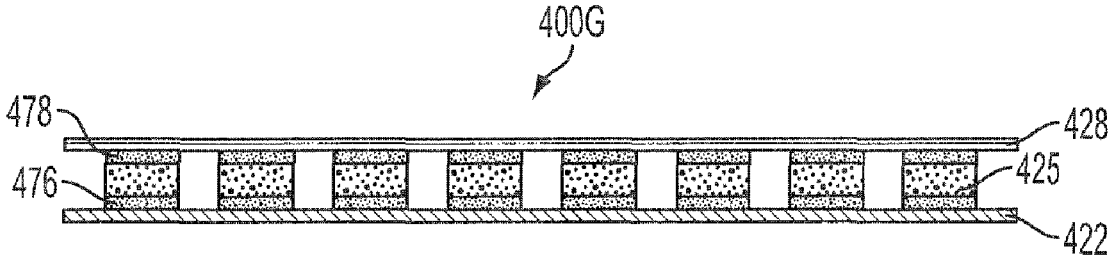

In FIG. 4G, an exemplary piezoelectric tape 400G (also see 120 in FIGS. 1-2) can be obtained by removing the rigid carrier plate 480 from the device 400F. As shown, the piezoelectric tape 400G can include a plurality of elements 425, such as piezoelectric ceramic elements, sandwiched between the first tape substrate 422 and the second tape substrate 428. The substrates 422 and 428 can be flexible and conductive or have a surface conductive layer.

Figure 4H:
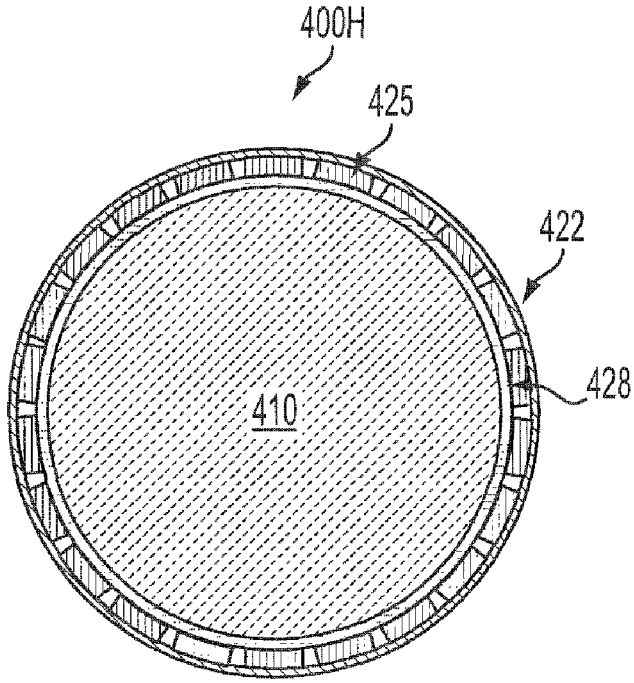

FIG. 4H depicts a cross section of an exemplary roll member 400H (also see the roll member 100 in FIG. 1B) including the formed piezoelectric tape 400G mounted upon an exemplary roll substrate 410. Specifically, for example, one of the first and second tape substrates (422/428) of the piezoelectric tape 400G can be wrapped around the peripheral circumferential surface of the roll substrate 410 to form the roll member 400H. In various embodiments, the piezoelectric tape 400G can be mounted on the roll substrate 410 (also see 110 of FIG. 1A) having large lateral dimensions.

In various embodiments, the exemplary roll member 400H can be formed using various other methods and processes. For example, in an alternative embodiment, one of the tape substrates, such as the first tape substrate 422 can be omitted from the device 400B, 400C, 400D, 400E, 400F and 400G in FIGS. 4B-4G resulting a piezoelectric tape 400G' (not shown) with one tape substrate, that is, having piezoelectric elements 425 formed on the one tape substrate 428. The piezoelectric tape 400G' (not shown) can then be mounted on the roll substrate 410 with the plurality of piezoelectric elements 425 exposed on the surface. Another tape substrate 422' can then be bonded onto the exposed piezoelectric elements 425 to form a roll member 400H'. In this case, the tape substrate 422' can have, for example, a sleeve-like shape, to be mounted onto the roll member to avoid an open gap on the surface.

Depending on the desired spatial resolution for a particular application, e.g., to release the toner particles, the dimension of the piezoelectric elements (see 125/225 in FIGS. 1-2 or 425 in FIG. 4) can also be controlled. For example, screen printed piezoelectric elements can provide lateral dimension as small as 50 μm×50 μm with a thickness ranging from about 30 μm to about 100 μm. In addition, the feature resolution of the disclosed piezoelectric elements (see 125/225 in FIGS. 1-2 or 425 in FIG. 4) can range from about 40 μm to about 500 μm. In an additional example, the feature resolution can be about 600 dpi or higher.

Various techniques, such as laser micromachining, can be used to provide finer feature resolution during the fabrication process as shown in FIG. 3 and/or FIGS. 4A-4H. In one example, a dummy piezoelectric film without patterning can be first screen printed or doctor bladed on a large area sapphire substrate (e.g., the substrate 274 in FIG. 2 and/or the substrate 474 in FIG. 4A). Laser micromachining pattern method can then be applied to obtain finer feature sizes. In another example, finer feature size can be obtained by patterning thin bulk PZT pieces (e.g., having a thickness of about 50 μm to about 1 mm) to form piezoelectric element arrays with fine PZT elements for a better piezoelectric properties (e.g., the piezoelectric displacement constant d33 can be higher than 500 pm/V). In this case, in order to have large lateral dimensions, a desired number of thin bulk PZT material (e.g., pieces) can be arranged together prior to the laser micromachining.

For example, FIGS. 5A-5D depict another exemplary roll member 500 at various stages of the fabrication in accordance with the present teachings. In this example, the fabrication process can be performed with a combination of any suitable cutting or machining techniques.

Figure 5A:
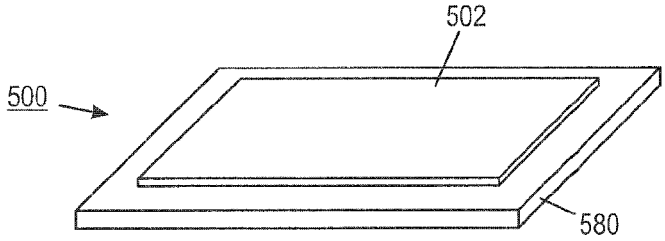
FIGS. 5A-5D depict another exemplary roll member at various stages of the fabrication in accordance with the present teachings.

In FIG. 5A, the device 500 can include a piece of thin bulk piezoelectric material (e.g., ceramic) 502 bonded on a carrier plate 580. The thin bulk piezoelectric material 502 can have a thickness ranging from about 50 μm to about 1 mm. The thin bulk piezoelectric material 502 can be bonded onto the carrier plate 580 using, e.g., a removal adhesive known to one of ordinary skill in the art. In various embodiments, a plurality of thin bulk piezoelectric material 502 can be placed on the carrier plate 580 to provide a desired large area for the subsequent formation of piezoelectric tapes.

Figure 5B:
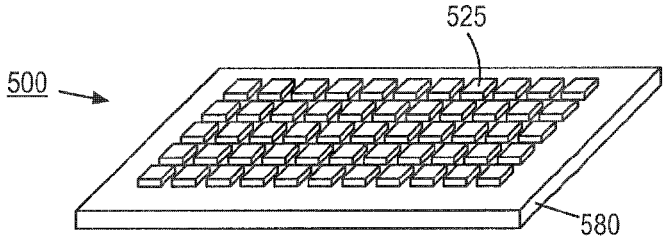

In FIG. 5B, each piece of the thin bulk piezoelectric material 502 (see FIG. 5A) can be cut into a number of small piezoelectric elements 525. This cutting process can be performed using suitable techniques, such as, for example, laser cutting and/or saw cutting. The dimensions of the cut piezoelectric elements 525 can be critical to determine the final resolution of the device 500. For example, in order to obtain a resolution of about 600 dpi, each small piezoelectric element 525 can be cut to have lateral dimensions of about 37 μm×37 μm with a interval gap of about 5 μm, that is, having an exemplary pitch of about 42 μm.

Figure 6:
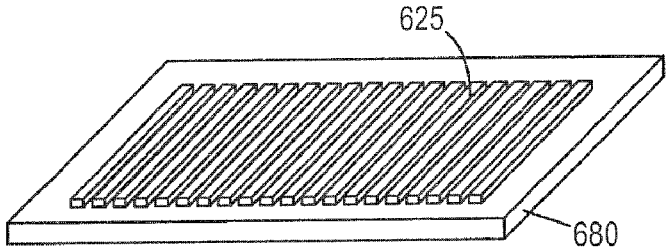
FIG. 6 depicts an alternative cutting structure for the small piezoelectric elements bonded onto a carrier plate in accordance with the present teachings.

In various embodiments, each piece of the thin bulk piezoelectric material 502 (see FIG. 5A) can be cut into a number of small piezoelectric elements 525, that have a variety of different geometric shapes/areas, and distributions in a single piezoelectric tape. FIG. 6 depicts an alternative cutting structure for the small piezoelectric elements 625 bonded onto a carrier plate 680 in accordance with the present teachings. As compared with the device 500 in FIG. 5B, the exemplary cut piezoelectric elements 625 can have a geometric shape of, for example, a long and narrow rectangular strip, which can provide flexibility in the horizontal direction.

Figure 5C:
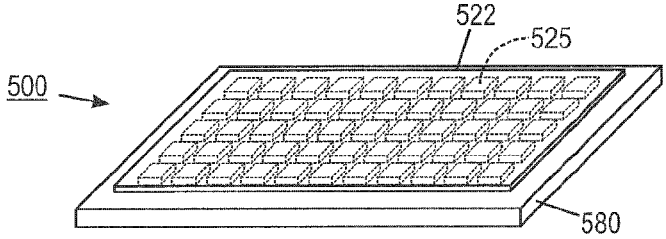

In FIG. 5C, the device 500 can include a first tape substrate 522 bonded onto the cut piezoelectric elements 525. The first tape substrate 522 can be a flexible and conductive material, such as a metal foil (thus it can also be used as common electrode) or a metallized polymer tape The metallized tape can include, for example, a metallization layer on a polymer. The first tape substrate 522 can be bonded onto the cut piezoelectric elements 525 using the disclosed bonding techniques including, but not limited to, a thin nonconductive epoxy bonding containing submicron conductive ball, a thin film intermetallic transient liquid phase bonding, or a conductive adhesive bonding.

Figure 5D:
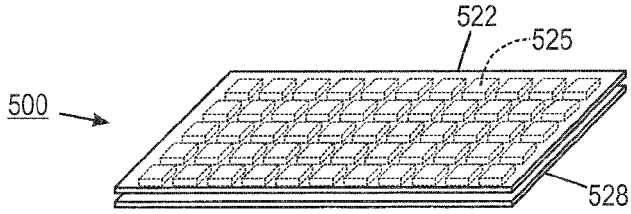

In FIG. 5D, the carrier plate 580 can be replaced by a second tape substrate 528. For example, the carrier plate 580 can be first removed from the device 500 shown in FIG. 5C, and the second tape substrate 528 can then be bonded onto the cut piezoelectric elements 525 from the other side that is opposite to the first tape substrate 522. As a result, the device 500 in FIG. 5D can have a plurality of small piezoelectric elements 525 configured between the two tape substrates 522 and 528 and thereby forming a piezoelectric tape. This piezoelectric tape in FIG. 5D can then be mounted onto a roll substrate (not shown), such as, the roll substrate 110 shown in FIGS. 1A-1B, and/or the roll substrate 410 shown in FIG. 4H to form a disclosed roll member (not shown) as similarly shown and described in FIGS. 1A-1B and FIG. 4H.

The formed roll member as describe above in FIGS. 1-5 can be used as, e.g., a donor roll for a development system in an electrophotographic printing machine. The donor roll can include a plurality of piezoelectric elements to locally actuate and vibrate toner particles with a displacement to release toner particles from the donor roll. In an exemplary theoretical calculations, the vibration displacement (d) generated under an applied voltage (V) can be described using the following equation:

$$d=d_{33}\cdot V \tag{1}$$

Where d33 is a displacement constant. Then the velocity can be:

$$v=2pf\cdot d=2pf\cdot d_{33}\cdot V \tag{2}$$

Where f is the frequency, and the acceleration a can be:

$$a=2pf\cdot v=(2pf)^2\cdot d33\cdot V \tag{3}$$

Then the force applied on the toner particle can be:

$$F=ma=m\cdot(2pf)^2-d_{33}\cdot V \tag{4}$$

Where m is the mass of the toner particle. According to the equation (4), if assuming the d33 of the piezoelectric elements is about 350 pm/V, the applied voltage is about 50 V, the frequency is about 1 MHz, the toner particle diameter is about 7 μm and the density is about 1.1 g/cm$^3$, the vibration force can be calculated to be about 136 nN. Since the piezoelectric elements can be driven at 50V or lower, there can be no commutation problem while transferring drive power to the circuitry. Generally, adhesion forces of toner particles to the donor roll can be from about 10 nN to about 200 nN. Thus the calculated force (e.g., about 136 nN) from the disclosed donor roll can be large enough to overcome the adhesion forces and hence generate uniform toner cloud. On the other hand, however, the frequency can be easily increased to be about 2 MHz, the generated force according to equation (4) can then be calculated to be about 544 nN, which is four times higher as compared with when the frequency is about 1 MHz and can easily overcome the adhesion force of toner particles to the donor roll.

Figure 7:
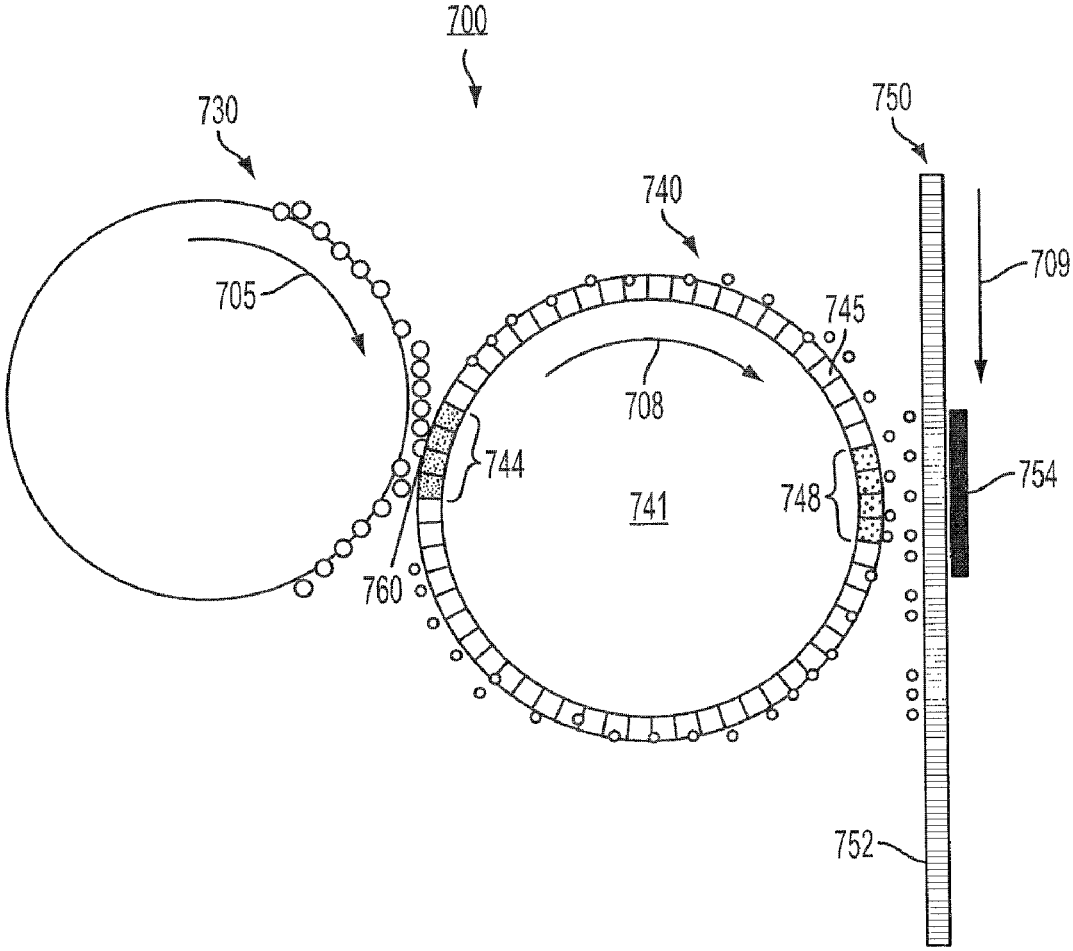
FIG. 7 depicts an exemplary development system using a donor roll member in an electrophotographic printing machine in accordance with the present teachings.

FIG. 7 depicts an exemplary development system 700 using a donor roll member in an electrophotographic printing machine in accordance with the present teachings. It should be readily apparent to one of ordinary skill in the art that the system 700 depicted in FIG. 7 represents a generalized schematic illustration and that other members/particles can be added or existing members/particles can be removed or modified.

The development system 700 can include a magnetic roll 730, a donor roll 740 and an image receiving member 750. The donor roll 740 can be disposed between the magnetic roll 730 and the image receiving member 750 for developing electrostatic latent image. The image receiving member 750 can be positioned having a gap with the donor roll 740. Although one donor roll 740 is shown in FIG. 7, one of ordinary skill in the art will understand that multiple donor rolls 740 can be used for each magnetic roll 730.

The magnetic roll 730 can be disposed interiorly of the chamber of developer housing to convey the developer material to the donor roller 740, which can be at least partially mounted in the chamber of developer housing. The chamber in developer housing can store a supply of developer material. The developer material can be, for example, a two-component developer material of at least carrier granules having toner particles adhering triboelectrically thereto.

The magnetic roller 730 can include a non-magnetic tubular member (not shown) made from, e.g., aluminum, and having the exterior circumferential surface thereof roughened. The magnetic roller 730 can further include an elongated magnet (not shown) positioned interiorly of and spaced from the tubular member. The magnet can be mounted stationarily. The tubular member can rotate in the direction of arrow 705 to advance the developer material 760 adhering thereto into a loading zone 744 of the donor roll 740. The magnetic roller 730 can be electrically biased relative to the donor roller 740 so that the toner particles 760 can be attracted from the carrier granules of the magnetic roller 730 to the donor roller 740 in the loading zone 744. The magnetic roller 730 can advance a constant quantity of toner particles having a substantially constant charge onto the donor roll 740. This can ensure donor roller 740 to provide a constant amount of toner having a substantially constant charge in the subsequent development zone 748 of the donor roll 740.

The donor roller 740 can be the roll member as similarly described in FIGS. 1-6 having a piezoelectric tape mounted on the a roll substrate 741. The donor roll 740 can include a plurality of electrical connections (not shown) embedded therein or integral therewith, and insulated from the roll substrate 741 of the donor roll 740. The electrical connections can be electrically biased in the development zone 748 of the donor roll 740 to vibrate and detach the developed toner particles from the donor roll 740 to the image receiving member 750. The image receiving member 750 can include a photoconductive surface 752 deposited on an electrically grounded substrate 754.

The vibration of the development zone 748 can be spatially controlled by individually or in-groups addressing one or more piezoelectric elements 745 of the donor roll 740 using the biased electrical connections, e.g., by means of a brush, to energize only those one or more piezoelectric elements 745 in the development zone 748. For example, the donor roll 740 can rotate in the direction of arrow 708. Successive piezoelectric elements 745 can then be advanced into the development zone 748 and can be electrically biased. Toner loaded on the surface of donor roll 740 can jump off the surface of the donor roll 740 and form a powder cloud in the gap between the donor roll 740 and the photoconductive surface 752 of the image receiving member 750, where development is needed. Some of the toner particles in the toner powder cloud can be attracted to the conductive surface 752 of the image receiving member 750 thereby developing the electrostatic latent image (toned image).

The image receiving member 750 can move in the direction of arrow 709 to advance successive portions of photoconductive surface 752 sequentially through the various processing stations disposed about the path of movement thereof In an exemplary embodiment, the image receiving member 750 can be any image receptor, such as that shown in FIG. 7 in a form of belt photoreceptor. In various embodiments, the image receiving member 750 can also be a photoreceptor drum as known in the art to have toned images formed thereon. The toner images can then be transferred from the photoconductive drum to an intermediate transfer member and finally transferred to a printing substrate, such as, a copy sheet.

Exemplary embodiments also provide a direct imaging system and methods for direct marking an image using the system. The disclosed direct imaging system can eliminate use of at least one of the charge and/or exposure subsystems in an electrophotographic machine and related processes. Specifically, the direct imaging system can include a direct marking substrate (e.g., a printing substrate) and a development roll member closely spaced from the direct marking substrate. In one embodiment, the development roll member, such as a donor roll member, can include a plurality of actuator cells (e.g., piezoelectric elements) with each actuator cell controllably addressable to eject one or more toner particles adhered thereto. The ejected toner particles can transit the space between the donor roll member and the direct marking substrate, and thereby marking onto the direct marking substrate forming an image. For example, the image can be a final printing image on a paper sheet without using a photoreceptor, which is typically used to create and hold a latent image in a conventional image development system.

Figure 8:
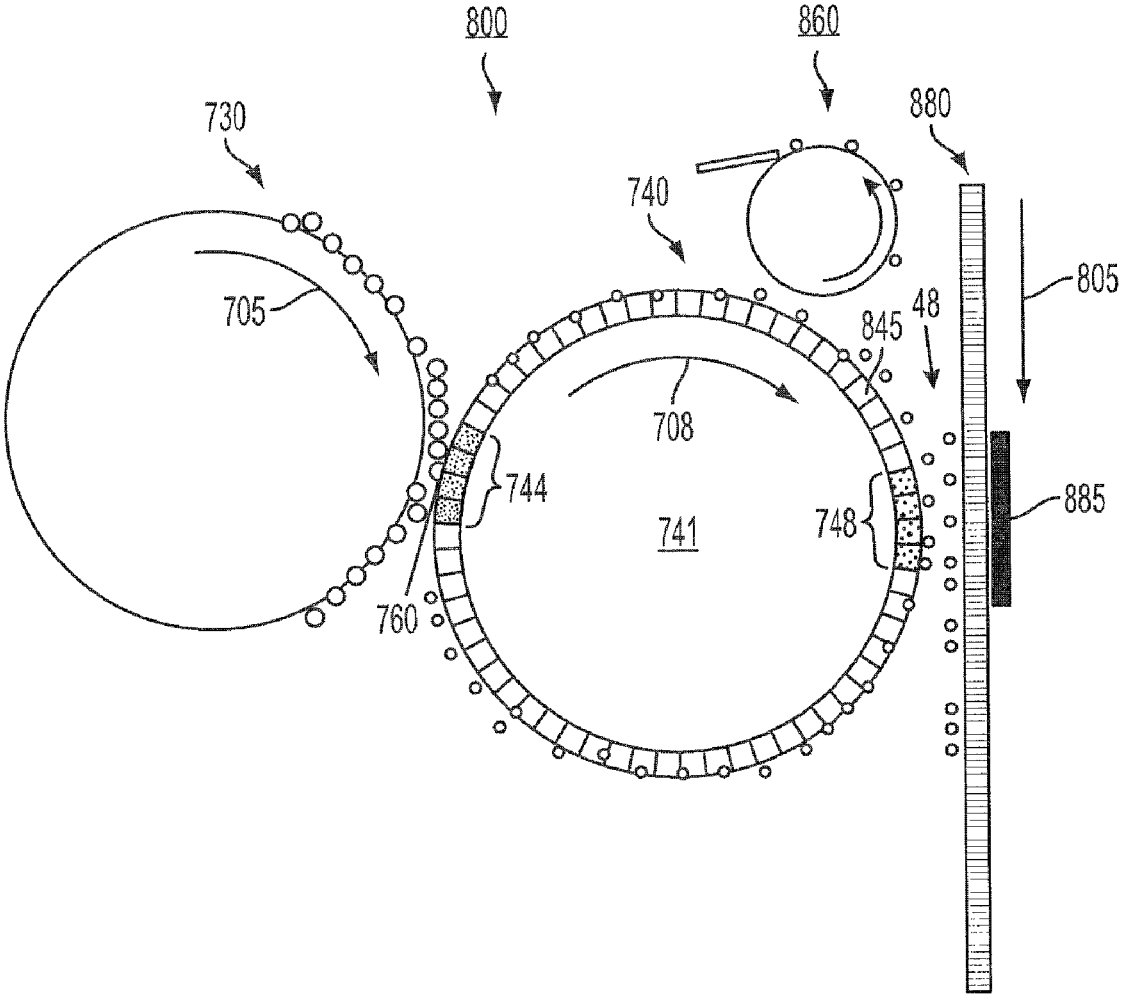
FIG. 8 depicts an exemplary direct imaging system using a roll member extended from the roll member of FIGS. 1A-1B in accordance with the present teachings.

FIG. 8 depicts an exemplary direct imaging system 800 in accordance with the present teachings. It should be readily apparent to one of ordinary skill in the art that the system 800 depicted in FIG. 8 represents a generalized schematic illustration and that other members/particles/substrates can be added or existing members/particles/substrates can be removed or modified.

As shown, the exemplary direct imaging system 800 can include a magnetic roll 730, a donor roll 740 and a direct marking substrate 880. The donor roll 740 can be disposed between the magnetic roll 730 and the direct marking substrate 880 for imaging on the direct marking substrate 880. The direct marking substrate 880 can be positioned having a development gap 48 with the donor roll 740. Note that although one donor roll 740 is illustrated in FIG. 7, one of ordinary skill in the art will understand that multiple donor rolls 740 can be used for each magnetic roll 730, or one or more magnetic rolls can be used for each donor roll.

In various embodiments, the magnetic roll 730 can be similar as that described above for FIG. 7 and as known to one of ordinary skill in the related art.

In various embodiments, the donor roll 740 can be similar as that described above for FIG. 7 having a plurality of individually addressable piezoelectric elements (see 745 of FIG. 7 and see 125 of FIGS. 1A-1B) to control the ejected toner by the address of the piezoelectric elements.

In various embodiments, the donor roll 740 can be extended to include a plurality of actuator cells 845 disposed over the roll substrate 741 (also see 110 of FIGS. 1A-1B). The actuator cells 845 can be extended to include any actuator device that is capable of effectively transforming electrical energy to mechanical energy and vice versa. For example, the actuator cell 845 can include an actuator membrane, such as a piezoelement or a cantilever, being capable of displacing by electrostatic forces.

In various embodiments, the plurality of actuator cells 845 of the donor roll 740 can be addressable individually or in groups to provide desired image resolution on the direct marking substrate 880. For example, each actuator cell can correspond to one pixel in the image on the direct marking substrate 880. In various embodiments, the plurality of actuator cells 845 can be arranged to include one or more isolated actuator cells and/or one or more cell rows of the actuator cells configured perpendicular to a process direction, e.g., at 708 of the donor roll member 740.

Non-limiting examples of the actuator cells 845 used for the donor roll 740 can include the piezoelectric actuators as described herein and/or other MEMS (micro-electro-mechanical systems) actuators. For example, the actuator cells 845 can include those piezoelectric elements produced from a piezoelectric ceramic material, an antiferroelectric material, an electrostrictive material, a magnetostrictive material or other functional ceramic material.

The MEMS actuators can include, for example, an electromechanically tunable Fabry-Perot optical actuator as described in related U.S. patent application Ser. No. 11/016,952, entitled "Full Width Array Mechanically Tunable Spectrophotometer," which is hereby incorporated by reference in its entirety. Alternatively, the MEMS actuator can include, for example, a MEMS device including an electrode layer and an actuator membrane. The actuator membrane can be positioned in proximity to the electrode layer so as to provide a gap therebetween for the actuator membrane being capable of deflecting/displacing toward the electrode layer.

In various embodiments, a digital development system can be used for the direct imaging system 800 as disclosed herein. The digital development system can include, for example, those described in the related U.S. patent application Ser. No. 12/208,103 entitled "Addressable Actuators for a Digital Development System," filed Sep. 10, 2008, which is hereby incorporated by reference in its entirety.

For example, the digital development system can include a donor roll used as a high-quality imager including matrix-addressable actuator cells arranged in a 2-dimensional array with each cell having an actuator membrane (including a piezo-element) individually addressable to eject one or more toner particles attracted/adhered thereto. In addition, the digital development system can utilize an imager architecture that includes an addressing logic circuit connected to each cell to selectively control the ejection of the one or more toner particles. Toner adhesion can then be overcome in a controlled manner by the actuator cell vibration and electrostatics forces within the development gap as well as the individual addressability of each cell. Further, such digital development system can provide an image-wise addressability, e.g., to produce addressable toner cloud in the development area, on a moving assembly of the image development system, for example, as that illustrated in FIG. 7.

Referring back to FIG. 8, the direct marking substrate 880 can receive toned images from the development area 748. The direct marking substrate 880 can include, for example, one or more of an intermediate belt, an intermediate drum or a final printing substrate, without use of any photoreceptor or explicit latent image. Toned images can be formed directly on the direct marking substrate 880. In an exemplary embodiment, toned image can be "printed" onto a final substrate (e.g., a paper sheet) without requiring any transfer subsystem for intermediate toner transportation (e.g., belt or drum).

The direct marking substrate 880 can be charged at 885 in order to mark images thereon. A component for charging the direct marking substrate 880 can thus be included. For example, the direct marking substrate 880 can be an intermediate belt or drum substrate charged with a voltage of opposite polarity to that of the toner (e.g., back biased), while the surface of the donor roll 740 can be held near ground potential. In an exemplary embodiment, the direct marking substrate 880 can include a paper media having a metallic bias plate 885 for providing the charging component of the back-bias. Electrostatic field within the development gap 48 between the donor roll 740 and the direct marking substrate 880 can then be generated.

Upon operating the system shown in FIG. 8, charged toner particles can be loaded onto the donor roll 740 using any techniques known to one of ordinary skill in the art, e.g., using a two-component magnetic brush from the magnetic roll 730. The donor roll 740 can be moving synchronously with the direct marking substrate 880, and can be actuated in the development area 748. For example, one or more actuator cells of the plurality of actuator cells 845 at the development area 748 can be selectively addressed/controlled to vibrate and eject the loaded charged toner, which corresponds to the pixels in the directly marked image.

In this case, the controllable vibration can release the toner from the donor roll 740, without imparting a momentum to significantly affect the particles' trajectory across the gap 48. Such vibration in these actuator cells at the development area 748 can represent intended images on the direct marking substrate 880. For example, each of these actuator cells that corresponds to an image pixel can be designed to vibrate at a regulated frequency ranging from about 100 kHz to about 350 kHz, (e.g., about 275 kHz) and to vibrate at a low amplitude ranging from about 0.5 micron to about 2.0 microns (e.g., about 1 micron) to reduce the net attraction force between the toner and the donor surface 748 at the development gap 48. In various embodiments, the required frequency and the amplitude can be highly dependent on the toner size and charge.

As the donor roll 740 rotates during operation, the actuator cells to be actuated can become close to the direct marking substrate 880 forming the development gap 48, e.g., having a width on the order of about 100 microns or more, such as about 100 microns to about 400 microns. Meanwhile, the electrostatic field within the development gap 48 can force the released toner particles to transit the air gap 48 towards a desired region of the direct marking substrate that is above the development surface 748 of the donor roll 740. In this manner, toner residing above those vibrating actuator cells at the development area 748 can have a reduced adhesion and/or can be further detached by the electrostatic force produced by the electric field within the development gap 48 between donor roll 740 and the direct marking substrate 880.

As disclosed, the electric field can be maintained by biasing the direct marking substrate 880 at 885 with respect to the donor roll 740. In various embodiments, the bias potential of the direct marking substrate 880 can be chosen so that electric field strength within the gap 48 can be sufficient to pull released toner across the gap 48, but can still keep toner remaining on the donor roll 740 when the actuator(s) at the development area 748 are not controlled to vibrate. In an exemplary embodiment, suitable electric-field strength can be about 0.5 volt/micron to about 3.5 volts/micron. In an additional example, the electric field strength can be about 1 volt/micron to about 2 volts/micron.

Once detached, the toner can be moved across the development gap 48 due to the known Lorentz force and deposited on the direct marking substrate 880. The toner that has not been developed can remain on the moving donor roll 740 and can be transported back into the exemplary magnetic brush reload zone 744, where the empty spaces can be refilled by toner from the magnetic brush of the magnetic roll 730.

In various embodiments, to prevent reload of aged toner at the loading/reloading area 744, the un-developed toner on the donor surface 740 can be cleaned electrostatically and/or vibrationally prior to the reloading process as described in the related U.S. patent application Ser. No. 12/208,078, entitled "Active Image State Control with Linear Distributed Actuators on Development Rolls," filed Sep. 10, 2008, which is hereby incorporated by reference in its entirety.

In this manner, the use of vibration, electrostatics field, and individual addressability of the actuator cells 845 of the donor roll 740 can overcome toner adhesion in a controlled manner. That is, individually addressable donor roll 740 can be used as an imager to create directly toned images on a region of interest of the direct marking substrate 880 without using the charge and exposure subsystems, in particular, without using a photoreceptor. In addition, by choosing the magnitude of the electric field strength, in consideration of the charge and adhesion properties of the toner particles, a uniform and sufficiently dark image without excessive background noise can be developed. Fundamental physics of toner kinetics (not illustrated) in the development gap 48 shows that uniform image development can be performed without the latent image. For example, the direct imaging system 800 can provide a resolution at about 600 dpi or higher using a variety of toner sets with varying charge-to-mass ratios (i.e., the "tribo").

In various embodiments, to further improve the image quality, the plurality of actuator cells 845 can be linearly distributed around the circumference of the roll substrate 741 with an orientation in an axial direction (similarly see 105 at FIG. 1A). For example, one or more linear arrays or one or more cell rows of actuator cells 845 can be arranged along the axial direction of the roll substrate 740 and perpendicular to the process direction 708. In various embodiments, one linear array or one row of the actuator cells can be offset from its previous linear array or row of the actuator cells, e.g., by about one-half of a pixel of the final image on the direct marking substrate 880. Such configuration can allow the control software, e.g., the addressing logic circuit, to fill in gaps that can otherwise be left by the inactive regions between individual actuators.

Exemplary linear distributed actuator cells for a donor roll can also include those described in the related U.S. patent application Ser. No. 12/208,078, entitled "Active Image State Control with Linear Distributed Actuators on Development Rolls," filed Sep. 10, 2008, which is hereby incorporated by reference in its entirety.

Note that it is not necessary to have the entire surface of the donor roll 740 covered by the actuator cells 845. In one embodiment, a small number of rolls/linear arrays of actuator cells can be sufficient to form a complete image on the direct marking substrate 880. In a specific embodiment when with only one row of actuator cells 845 on the donor roll 740, the process speed can be very slow as the direct marking substrate 880 has to be moving very slowly with respect to the donor roll's surface. The plurality of actuator cells 845 can therefore have a surface coverage of about 100% or less of the donor roll member 740. In various embodiments, the actual coverage of the donor roll 740 can be an engineering trade off between the effective process speed of the printing machine and the cost of manufacturing the donor roll(s) 740.

Likewise, individual actuator cells 845 are not required to be placed next to each other in order to achieve high image resolutions. This is because, by applying multiple donor passes, a high-resolution image can also be built up from a low resolution print head.

In various embodiments, to further reduce the background noise due to the weakly adhered toner, a stripping roll 860 can be inserted as shown in FIG. 8. The stripping roll 860 can be a small (e.g., about 1 cm long) rotating metallic cylinder biased at a similar potential to the receiving surface of the direct marking substrate 880 and with a similar air gap. As the loaded donor roll 740 passes beneath it, the related actuator cells 845 can be controlled off, and only weakly bonded toner are attracted/adhered to the donor roll 740. The stripping roll 860 can be used to remove such weakly bonded toner since it can later appear as background noise in the final image In various embodiments, a simple cleaning blade can be used to clean the stripping roll 860 with excess toner particles being returned to the sump region to be recycled.

As disclosed herein, the exemplary direct imaging system 800 shown in FIG. 8 can provide many advantages. For example, an interesting design point can be that there are few critical requirements on any of the physical dimensions or voltages involved in the disclosed imaging system 800. In addition, the developed toner can transit across the development gap 48 forming the image mainly due to the controllable vibration of the actuator cells 845 rather than only due to the electric field as known in the prior art. Therefore, the gaps for both the development area and the stripping roll are not necessarily maintained at high tolerance. Further, the exact position of a developed pixel can be determined by the actuation timing when a specific actuator cell is fired to vibrate in relation to the position of the donor roll and the direct marking substrate. The disclosed direct imaging system can thus replace strict mechanical tolerances with the flexibility inherent and with software-based process control.

Various embodiments can further include a direct imaging system having a belt configuration and methods for direct marking an image using the belt-configured direct imaging system. The belt-configured direct imaging system can eliminate use of at least one of the charge and/or exposure subsystems in an electrophotographic machine and related processes. Specifically, the belt-configured direct imaging system can include a direct marking substrate (e.g., a printing substrate), as similarly described in FIG. 8, and a development belt member closely spaced from the direct marking substrate. In one embodiment, the development belt member, such as a donor belt member, can include a plurality of actuator cells (e.g., piezoelectric elements or MEMS actuators) with each actuator cell controllably addressable to eject one or more toner particles adhered thereto. The ejected toner particles can transit the space between the donor belt member and the direct marking substrate, and thereby marking onto the direct marking substrate forming an image. For example, the image can be a final printing image on a paper sheet without using a photoreceptor, which is typically used to create and hold a latent image in a conventional image development system.

Figure 9:
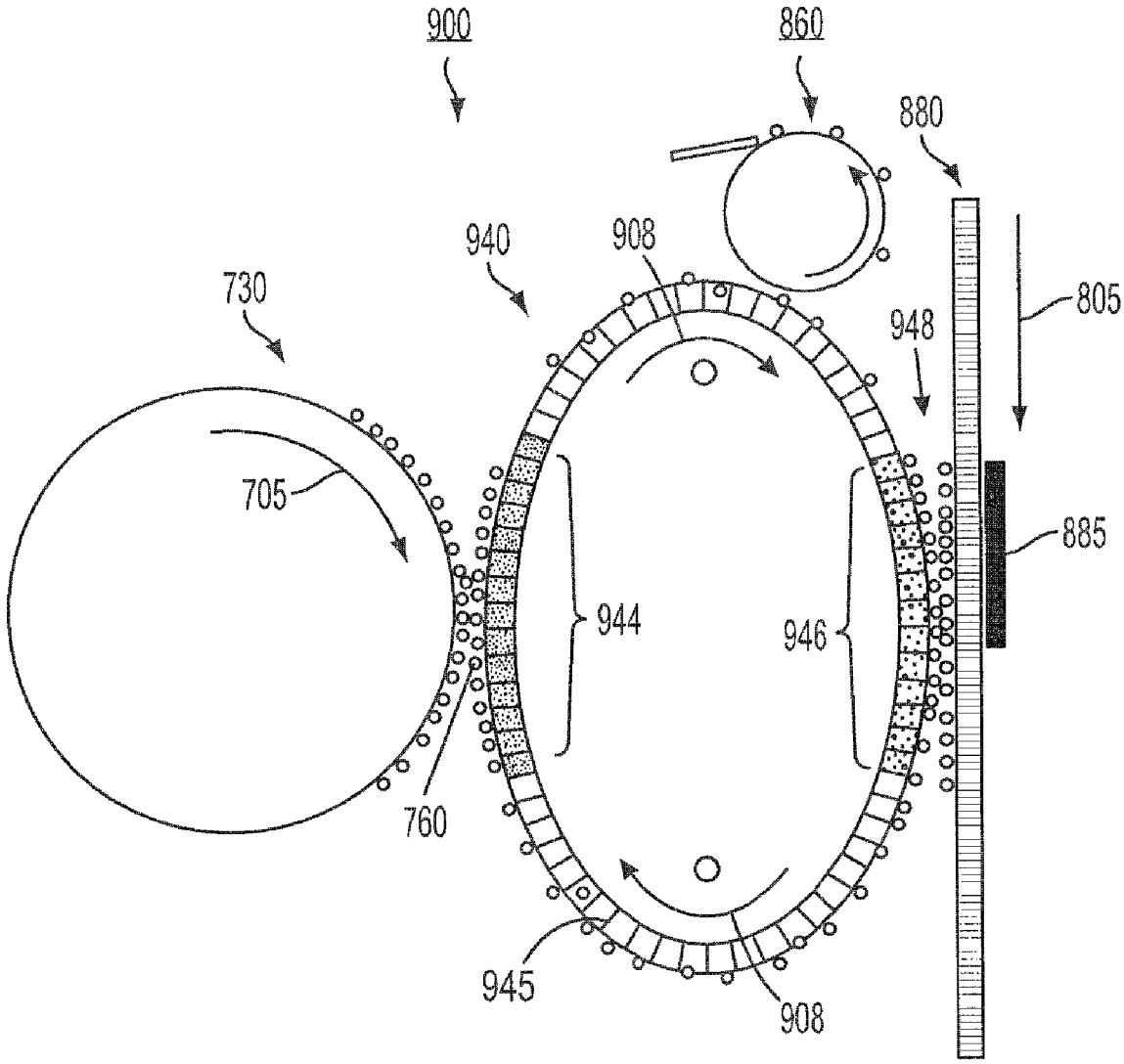
FIG. 9 depicts an exemplary direct imaging system using a belt configuration in accordance with the present teachings.

FIG. 9 depicts an exemplary direct imaging system 900 using a belt member in accordance with the present teachings. It should be readily apparent to one of ordinary skill in the art that the system 900 depicted in FIG. 9 represents a generalized schematic illustration and that other members/particles/substrates can be added or existing members/particles/substrates can be removed or modified.

As shown, the exemplary belt-configured direct imaging system 900 can include a magnetic roll 730, an exemplary donor belt member 940 and a direct marking substrate 880.

In various embodiments, the magnetic roll 730 can be similar to those described above with reference to FIGS. 7-8 and to magnetic rolls known to one of ordinary skill in the art. Like the donor roll 740 shown in FIGS. 7-8, the donor belt member 940 can be disposed between the magnetic roll 730 and the direct marking substrate 880 for forming an image on the direct marking substrate 880. The direct marking substrate 880 can be positioned having a development gap 948 with the donor belt member 940. Note that although one magnetic roll 730 is illustrated in FIG. 9, one of ordinary skill in the art will understand that multiple magnetic rolls 730 can be used for each donor belt member 940

In various embodiments, the direct marking substrate 880 can receive toned images from the development area 948 between the donor belt member 940 and the direct marking substrate 880. The direct marking substrate 880 can include, for example, one or more of an intermediate drum, an intermediate belt, or a final printing substrate, without use of any photoreceptor or explicit latent image. Toned images can be formed directly on the direct marking substrate 880. In an exemplary embodiment, toned image can be "printed" onto a final printing substrate (e.g., a sheet of paper) without requiring any transfer subsystem for intermediate toner transportation (e.g., belt or drum).

Figure 10:
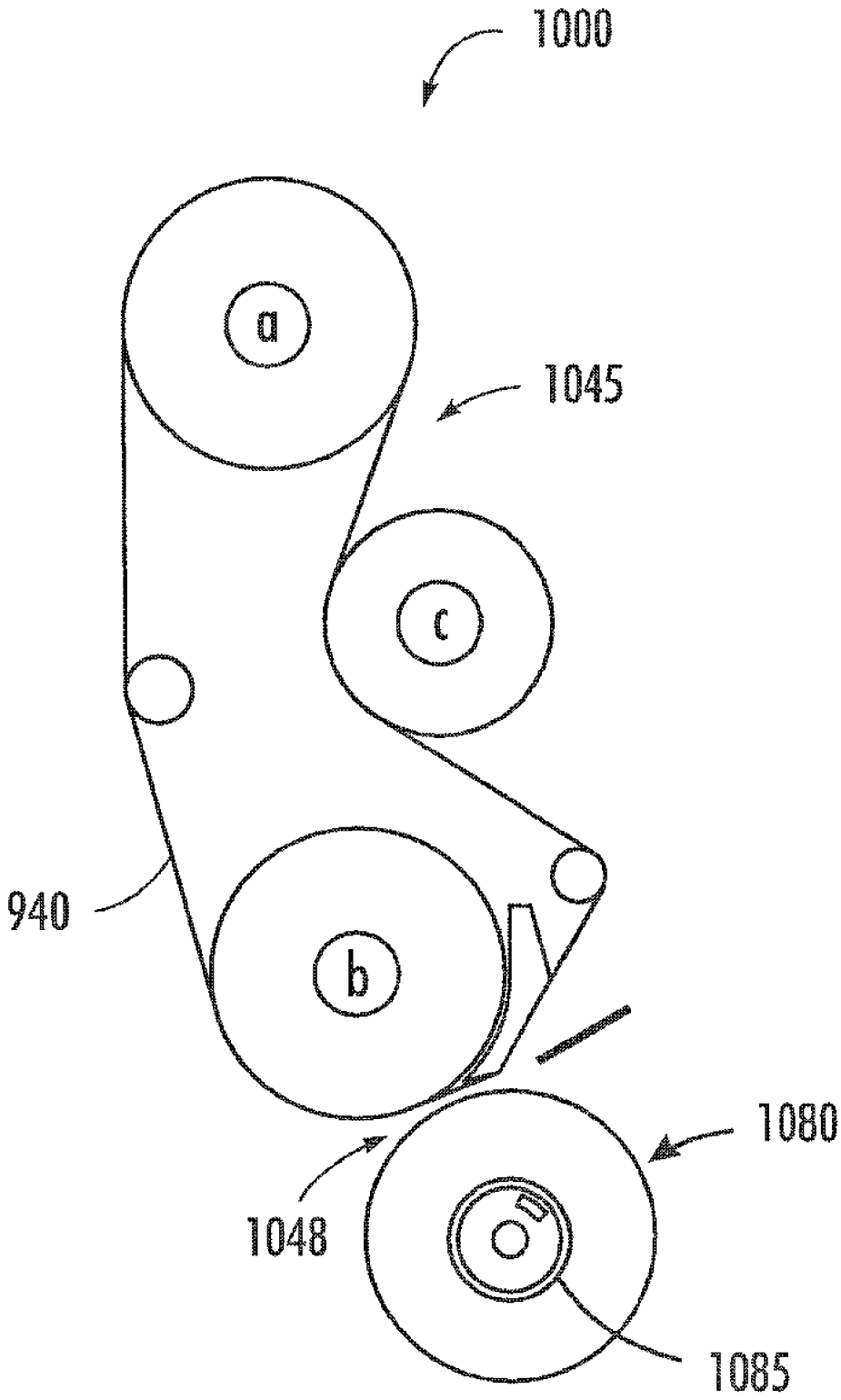
FIG. 10 depicts a portion of an exemplary belt-configured development system in accordance with the present teachings.
Figure 11:
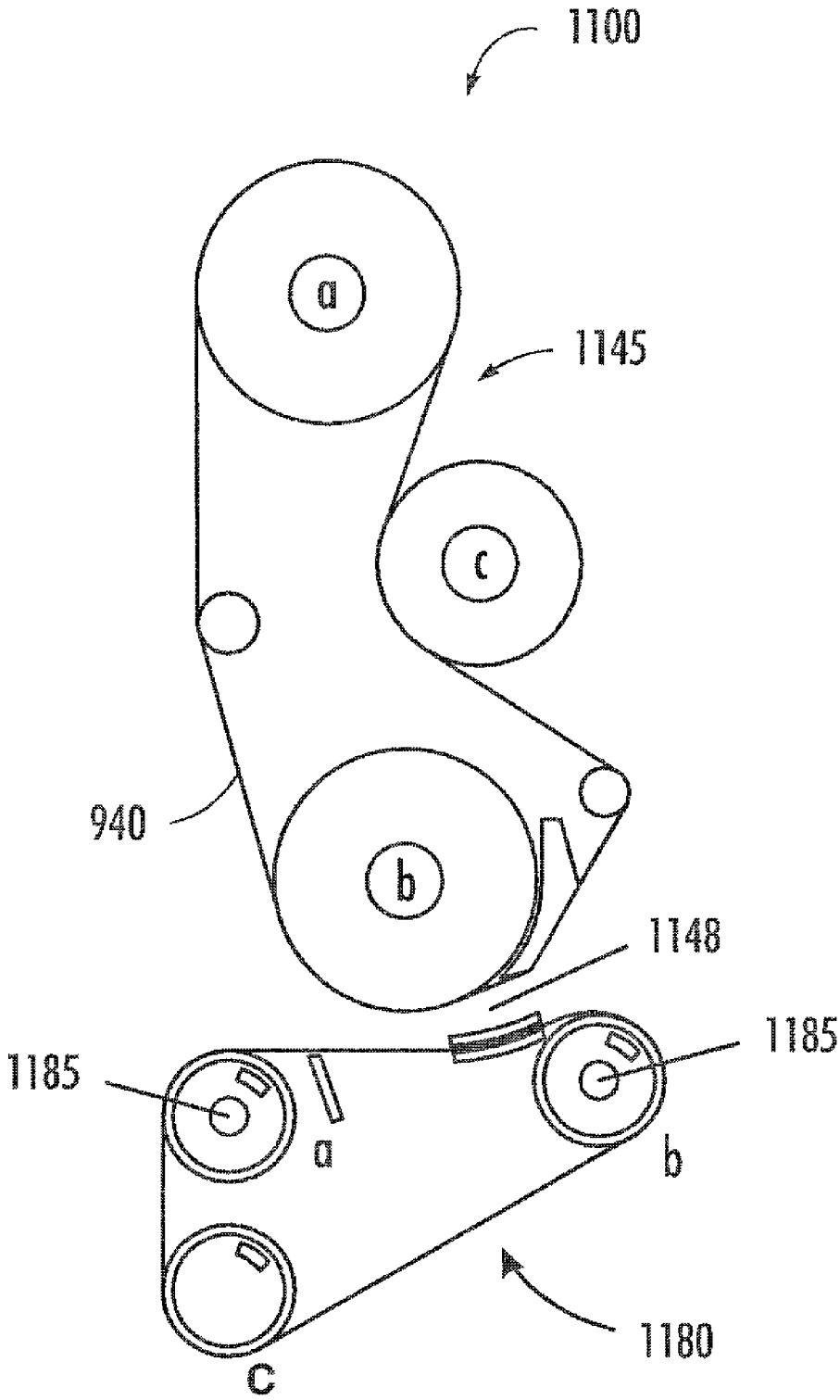
FIG. 11 depicts a portion of another exemplary belt-configured development system in accordance with the present teachings.

In various embodiments, the donor belt member 940 can have a belt configuration for the disclosed development system. FIGS. 10-11 depict various examples of a portion of a belt-configured development system for the disclosed direct imaging systems in accordance with the present teachings.

For example, as shown in FIG. 10, a portion of the exemplary development system 1000 can include a belt configuration having a donor belt member 940 and a mechanical system 1045, and an exemplary intermediate drum 1080 used as the direct marking substrate (also see 880 in FIGS. 8-9). As shown, the mechanical system 1045 can include one or more mechanical rolls 1045*a-c* to move the donor belt 940 and thus developing images through the development area 1048 onto the direct marking substrate, i.e., the intermediate drum 1080.

In another example, as shown in FIG. 11, a portion of the exemplary development system 1100 can include another belt configuration having a donor belt member 940 and a mechanical system 1145, and an exemplary intermediate belt 1180 used as the direct marking substrate (also see 880 in FIGS. 8-9). As shown, the mechanical system 1145 can include one or more mechanical rolls 1145*a-c* to move the donor belt member 940 and thus transit the toner particles through the development area 1148 onto the direct marking substrate, i.e., the intermediate belt 1180. In various embodiments, the intermediate belt 1180 can also include one or more mechanical rolls 1180*a-c* to move the intermediate belt 1180.

In various embodiments, the direct marking substrates, for example, the intermediate drum 1080 in FIG. 10, the intermediate belt 1180 in FIG. 11 and/or a final printing substrate (e.g., a paper substrate) (not shown), can include a component for charging the direct marking substrates. For example, in FIG. 9, the direct marking substrate 880 can be charged at 885 in order to mark images thereon; in FIG. 10, the direct marking intermediate drum 1080 can be charged at 1085; and in FIG. 11, the direct marking intermediate belt 1180 can be charged at 1185*a* and/or 1185*b*.

In an exemplary embodiment shown in FIG. 9, the direct marking substrate 880 can include a paper media having a metallic bias plate (see 885) for providing the charging component of the back-bias. Electrostatic field within the development gap 948 between the donor belt member 940 and the direct marking substrate 880 can then be generated.

In the illustrated exemplary embodiments of FIGS. 10-11, the direct marking substrate, such as the intermediate drum substrate 1080 or the intermediate belt substrate 1180, can also be charged with a voltage of opposite polarity to that of the toner (e.g., back biased), while the surface of the donor belt member 940 can be held near ground potential to generate an electrostatic field.

During operation, such exemplary direct marking substrates (erg., 880, 1080 and/or 1180) can be a moving substrate in order to form images thereon. In various embodiments, in addition to moving the direct marking substrates, the donor belt member 940 can be moving during the image development.

In various embodiments, as compared with the roll configuration, the belt configuration as shown in FIGS. 9-11 for the toner development system can provide many advantages. For example, the belt configuration can provide more effective area for advancing developer material 760 (see FIG. 9) and can provide a more effective area for the toner development (see the development area 948, 1048 and/or 1148 in FIGS. 9-11). In addition, the belt configuration can provide surface compliance to arbitrary geometries of objects used in the development system.

In various embodiments, the donor belt member 940 can include a plurality of actuator cells 945. The actuator cells 945 can include any actuator device that is capable of effectively transforming electrical energy to mechanical energy and vice versa. For example, the actuator cell 945 can include an actuator membrane, such as a piezoelement or a cantilever, being capable of displacing by electrostatic forces.

In an exemplary embodiment, the donor belt member 940 can include a plurality of individually addressable piezoelectric actuator cells configured as a belt to control the ejected toner by the address of the piezoelectric elements. In another exemplary embodiment, the donor belt member 940 can include a plurality of MEMS actuator cells configured as a belt to control the toner development and forming images directly on the direct marking substrates.

Non-limiting examples of the actuator cells 945 used for the donor belt member 940 can include the piezoelectric actuators as described herein and/or other MEMS (micro-electro-mechanical systems) actuators. For example, the actuator cells 945 can include those piezoelectric elements produced from a piezoelectric ceramic material, an antiferroelectric material, an electrostrictive material, a magnetostrictive material or other functional ceramic material.

The MEMS actuators can include, for example, an electromechanically tunable Fabry-Perot optical actuator as described in related U.S. patent application, Ser. No. 11/016,952, entitled "Full Width Array Mechanically Tunable Spectrophotometer," which is hereby incorporated by reference in its entirety. Alternatively, the MEMS actuator can include, for example, a MEMS device including an electrode layer and an actuator membrane. The actuator membrane can be positioned in proximity to the electrode layer so as to provide a gap therebetween for the actuator membrane being capable of deflecting/displacing toward the electrode layer.

In various embodiments, the plurality of actuator cells 945 of the donor belt member 940 can be addressable individually or in groups to provide desired image resolution on the direct marking substrate 880, 1080 and/or 1180 as shown in FIGS. 8-11). For example, each actuator cell 940 can correspond to one pixel in the image on the direct marking substrate. In various embodiments, the plurality of actuator cells 945 can be arranged to include one or more isolated actuator cells and/or one or more cell rows of the actuator cells configured perpendicular to a process direction, e.g., at 908 of FIG. 9 for the donor belt member 940.

In various embodiments, a digital development system can be used for the direct imaging system 900 as disclosed herein. The digital development system can include, for example, those described in the related U.S. patent application Ser. No. 12/208,103 entitled "Addressable Actuators for a Digital Development System," filed Sep. 10, 2008, which is hereby incorporated by reference in its entirety.

For example, the digital development system can include a donor belt used as a high-quality imager including matrix-addressable actuator cells arranged in a 2-dimensional array with each cell having an actuator membrane (including a piezo-element) individually addressable to eject one or more toner particles attracted/adhered thereto.

In addition, the digital development system can utilize an imager architecture that includes an addressing logic circuit connected to each actuator cell to selectively control the ejection of the one or more toner particles Toner adhesion can then be overcome in a controlled manner by the actuator cell vibration, electrostatics forces within the development gap, and the individual addressability of each cell. Further, such digital development system can provide an image-wise addressability, e.g., to produce addressable toner cloud in the development area and on a moving assembly of the image development system including a moving donor belt member and a moving direct marking substrate.

In various embodiments, a wireless addressable system (not shown) can be used in the development system to provide wireless communication between the belt member 940 and the direct marking substrate (see 880, 1080 and 1180 in FIGS.

8-11). The wireless addressable system can be connected to each actuator cell 945 to detect and sense the toner state thereon. The wireless addressable system can thus include, for example, a toner sensor, a microcontroller, and transmitter/receiver module that is often used for wireless signal transmission. In an exemplary embodiment, the toner sensor can sense the toner state on each actuator cell 945. The toner sensor signal can be transmitted to and processed by the microcontroller. The processed sensor signal can then be sent by the transmitter module, often configured with an antenna operating at a certain frequency to a remote wireless link. The transmitter module can serve as, for example, radio frequency (RF) front end for the remote wireless link. The transmitter module can further communicate to the receiver module. The receiver module can include, e.g., an antenna as a RF interface tuned to a desired frequency that corresponds to the transmitter module.

Upon operating the system shown in FIG. 9, charged toner particles can be loaded onto the donor belt member 940 using any techniques known to one of ordinary skill in the art, e.g., using a two-component magnetic brush from the magnetic roll 730. The donor belt member 940 can be moving synchronously with the direct marking substrate 880, and can be actuated in the development area at 946. For example, one or more actuator cells at 946 of the plurality of actuator cells 945 can be selectively addressed/controlled to vibrate and eject the loaded charged toner, which corresponds to the pixels in the directly marked image.

In this case, the controllable vibration can release the toner from the donor belt member 940, without imparting a momentum to significantly affect the particles' trajectory across the development gap 948. Such vibration in these actuator cells 946 at the development area can represent intended images on the direct marking substrate 880. For example, each of these actuator cells that corresponds to an image pixel can be designed to vibrate at a regulated frequency ranging from about 10 kHz to about 350 kHz, (e.g., about 275 kHz) and to vibrate at a low amplitude ranging from about 0.05 micron to about 2.0 microns (e.g., about 1 micron) to reduce the net attraction force between the toner and the donor belt surface at the development gap 948. In various embodiments, the required frequency and the amplitude can be highly dependent on the toner size and charge.

As the donor belt member 940 rotates during operation, the actuator cells to be actuated can come close to the direct marking substrate 880 forming the development gap 948, e.g., having a width on the order of about 100 microns or more, such as about 100 microns to about 400 microns. Meanwhile, the electrostatic field within the development gap 948 can force the released toner particles to transit the air gap 948 towards a desired region of the direct marking substrate that corresponds to the development surface 946. In this manner, toner residing above those vibrating actuator cells at 946 can have a reduced adhesion and/or can be further detached by the electrostatic force produced by the electric field within the development gap 948 between donor belt member 940 and the direct marking substrate 880.

As disclosed, the electric field can be maintained by biasing the direct marking substrate 880 at 885 with respect to the donor belt member 940. In various embodiments, the bias potential of the direct marking substrate 880 can be chosen so that electric field strength within the gap 948 can be sufficient to pull released toner across the gap 948, but can still keep toner remaining on the donor belt member 940 when the actuator(s) at the development area 948 are not controlled to vibrate. In an exemplary embodiment, suitable electric-field strength can be about 0.5 volt/micron to about 3.5 volts/micron. In an additional example, the electric field strength can be about 1 volt/micron to about 2 volts/micron.

Once detached, the toner can move across the development gap 948 due to the known Lorentz force and deposited on the direct marking substrate 880. Toner that has not been developed can remain on the moving donor belt member 940 and can be transported back into the exemplary magnetic brush reload zone 944, where the empty spaces can be refilled by toner from the magnetic brush of the magnetic roll 730.

In various embodiments, to prevent reload of aged toner at the loading/reloading area 944, the un-developed toner on the donor belt surface 940 can be cleaned electrostatically and/or vibrationally prior to the reloading process as described in the related U.S. patent application Ser. No. 12/208,078, entitled "Active Image State Control with Linear Distributed Actuators on Development Rolls," filed Sep. 10, 2008, which is hereby incorporated by reference in its entirety.

The use of vibration, electrostatics field, and individual addressability of the actuator cells 945 of the donor belt member 940 can overcome toner adhesion in a controlled manner. That is, individually addressable donor belt member 940 can be used as an imager to create directly toned images on a region of interest of the direct marking substrate 880 without using the charge and exposure subsystems, in particular, without using a photoreceptor or a latent image. In addition, by choosing the magnitude of the electric field strength, in consideration of the charge and adhesion properties of the toner particles, a uniform and sufficiently dark image without excessive background noise can be developed. Fundamental physics of toner kinetics (not illustrated) in the development gap 948 shows that uniform image development can be performed without the latent image. For example, the direct imaging system 800 can provide a resolution at about 600 dpi or higher using a variety of toner sets with varying charge-to-mass ratios (i.e., the "tribo").

In various embodiments, to further improve the image quality, the plurality of actuator cells 945 can be linearly distributed in the belt member 940 relative to the process direction of the belt member. For example, one or more linear arrays or one or more cell rows of actuator cells 945 can be arranged along the axial direction of the moving direction that is perpendicular to the process direction 908. In various embodiments, one linear array or one row of the actuator cells can be offset from its previous linear array or row of the actuator cells, e.g., by about one-half of a pixel of the final image on the direct marking substrate 880. Such configuration can allow the control software, e.g., the addressing logic circuit, to fill in gaps that can otherwise be left by the inactive regions between individual actuators.

Exemplary linear distributed actuator cells for a donor belt can also include those described for a donor roll in related U.S. patent application Ser. No. 12/208,078, entitled "Active Image State Control with Linear Distributed Actuators on Development Rolls," filed Sep. 10, 2008, which is hereby incorporated by reference in its entirety.

In various embodiments it may not be necessary to have the entire surface of the donor belt member 940 covered by the actuator cells 945. In one embodiment, a small number of rolls/linear arrays of actuator cells can be sufficient to form a complete image on the direct marking substrate 880. In a specific embodiment with only one row of actuator cells 945 on the donor belt member 940, the process speed can be controlled to be slow as the direct marking substrate 880 has to be moving very slowly with respect to the donor belt's surface. The plurality of actuator cells 945 can therefore have a surface coverage of about 100% or less of the donor belt member 940. In various embodiments, the actual coverage of the donor belt member 940 can be an engineering trade off between the effective process speed of the printing machine and the cost of manufacturing the donor belt member 940.

Likewise, individual actuator cells 945 are not required to be placed next to each other in the donor belt member 940 in order to achieve high image resolutions. This is because, by applying multiple donor passes, a high-resolution image can be built up from a low resolution print head.

In various embodiments, to further reduce the background noise due to the weakly adhered toner, a stripping roll 860 can be inserted in FIG. 9, which can be similar to that shown in FIG. 8. The stripping roll 860 can be a small (e.g., about I cm long) rotating metallic cylinder biased at a similar potential to the receiving surface of the direct marking substrate 880 and with a similar air gap. As the loaded donor belt member 940 passes beneath it, the related actuator cells 945 can be controlled off, and only weakly bonded toner are attracted/adhered to the donor belt member 940. The stripping roll 860 can be used to remove such weakly bonded toner since it can later appear as background noise in the final image. In various embodiments, a simple cleaning blade can be used to clean the stripping roll 860 with excess toner particles being returned to the sump region to be recycled.

As disclosed herein, the exemplary direct imaging systems shown in FIGS. 9-11 can provide many advantages. For example, a design point can be that there are few critical requirements on any of the physical dimensions or voltages involved in the disclosed imaging systems. In addition, the developed toner can transit across the development gap 948 (1048 or 1148) forming the image mainly due to the controllable vibration of the actuator cells 945 rather than only due to the electric field as known in the prior art Therefore, the gaps for both the development area and the stripping roll are not necessarily maintained at high tolerance, and the electric field or applied voltage can be reduced, or even totally removed. Further, the exact position of a developed pixel can be determined by the actuation timing when a specific actuator cell is fired to vibrate in relation to the position of the donor belt and the direct marking substrate. The disclosed direct imaging system can thus replace strict mechanical tolerances with the flexibility inherent and with software-based process control. Further more, the belt configuration of the development system can provide more effective area and more configuration compliance for the development system.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A direct imaging system comprising:

a direct marking substrate that does not include one or more of a charge subsystem, and an exposure subsystem; and a belt member closely spaced from the direct marking substrate, wherein the belt member comprises a plurality of actuator cells with each actuator cell being addressable to eject one or more toner particles adhered thereto, such that the ejected toner particles transit the space between the belt member and the direct marking substrate and onto the direct marking substrate forming an image.

2. The system of claim 1, further comprising an addressing logic circuit connected to one or more actuator cells of the belt member to selectively control the ejection of the one or more toner particles and the directly marked image.

3. The system of claim 1, further comprising a wireless communication between the belt member and the direct marking substrate, wherein each actuator cell is wirelessly addressed for detecting and control a toner state thereon.

4. The system of claim 1, wherein the direct marking substrate comprises one or more of an intermediate drum, an intermediate belt, or a printing substrate.

5. The system of claim 1, further comprising a charge of the direct marking substrate, wherein the charge provides an opposite polarity to the one or more toner particles transited on the direct marking substrate.

6. The system of claim 1, wherein the direct marking substrate is a paper media having a metallic bias plate.

7. The system of claim 1, wherein the plurality of actuator cells is addressable individually or in groups, each actuator cell corresponding to one or more pixels in the image on the direct marking substrate.

8. The system of claim 1, wherein the plurality of actuator cells comprises one or more isolated actuator cells or one or more cell rows of the actuator cells arranged perpendicular to a process direction of the belt member, wherein one cell row offsets from another cell row by one-half of a pixel.

9. The system of claim 1, wherein each actuator cell is addressed to vibrate at a frequency ranging from about 10 kHz to about 350 kHz and at a low amplitude ranging from about 0.05 micron to about 2.0 microns.

10. The system of claim 1, wherein each actuator cell comprises a piezoelectric element produced from a piezoelectric ceramic material, an antiferroelectric material an electrostrictive material, a magnetostrictive material or other functional ceramic material.

11. The system of claim 1, wherein each actuator cell comprises, an electrode layer; and an actuator membrane positioned in proximity to the electrode layer so as to provide a gap therebetween for the actuator membrane being capable of displacing toward the electrode layer.

12. The system of claim 1, wherein the space between the belt member and the direct marking substrate is about 100 microns or more.

13. The system of claim 1, further comprising a stripping roll to reduce background noise of the image on the direct marking substrate.

14. A method for direct marking an image comprising:

providing a direct marking substrate;

placing a belt member closely spaced from the direct marking substrate, wherein the belt member comprises a plurality of actuator cells with each actuator cell addressable to eject one or more toner particles adhered thereto; and vibrating one or more actuator cells of the plurality of actuator cells to transit the ejected toner particles onto the direct marking substrate to form an image without using a latent image.

15. The method of claim 14, further comprising using an addressing logic circuit connected to the plurality of actuator cells to selectively control the vibration and the ejection of the one or more toner particles from the one or more actuator cells.

16. The method of claim 14, further comprising applying a voltage bias to the direct marking substrate for providing an electric field strength between the belt member and the direct marking substrate to transit the ejected toner particles across the space therebetween.

17. The method of claim 14, further comprising selecting the electric field strength to be capable of keeping the one or more toner particles attracted on the belt member when the one or more actuator cells are not addressed to vibrate.

18. The method of claim 14, wherein the electric field strength is from about 0.5 volt/micron to about 3.5 volts/micron.

19. The method of claim 14, wherein the belt member and the direct marking substrate move synchronously with one another.

20. A direct imaging system comprising:

a direct marking substrate that is free of at least one of a charge subsystem and an exposure subsystem;

a donor belt closely spaced from the direct marking substrate for advancing toner particles onto the direct marking substrate, wherein the donor belt comprises a plurality of actuator cells with each actuator cell controllably addressable by one of an addressing logic circuit and a wireless communication to eject one or more toner particles attracted thereto, such that the ejected toner particles transit the space between the donor belt and the direct marking substrate and onto the direct marking substrate to form an image; and a stripping roll disposed with respect to the donor belt to reduce background noise of the image on the direct marking substrate.

* * * * *